US011526104B2

(12) United States Patent
Shimomura et al.

(10) Patent No.: US 11,526,104 B2
(45) Date of Patent: Dec. 13, 2022

(54) IMAGE FORMING APPARATUS CAPABLE OF SETTING TRANSFER VOLTAGE AND SUPPRESSING DETERIORATION OF MEMBERS DUE TO CONTROL OPERATION OF TRANSFER VOLTAGE

(71) Applicant: CANON KABUSHIKI KAISHA, Tokyo (JP)

(72) Inventors: Masaki Shimomura, Shizuoka (JP); Yoshiro Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/498,210

(22) Filed: Oct. 11, 2021

(65) Prior Publication Data

US 2022/0113657 A1 Apr. 14, 2022

(30) Foreign Application Priority Data

Oct. 12, 2020 (JP) ..... JP2020-172242

(51) Int. Cl.
*G03G 15/16* (2006.01)

(52) U.S. Cl.
CPC ..... *G03G 15/1675* (2013.01); *G03G 15/161* (2013.01)

(58) Field of Classification Search
CPC ..... G03G 15/1645; G03G 15/1675
USPC ..... 399/66
See application file for complete search history.

(56) References Cited

U.S. PATENT DOCUMENTS

| | | | | |
|---|---|---|---|---|
| 8,165,484 | B2 * | 4/2012 | Murayama | G03G 15/1675 399/66 |
| 9,372,446 | B2 * | 6/2016 | Nishikawa | G03G 15/1675 |
| 11,281,130 | B2 * | 3/2022 | Kakehi et al. | G03G 15/1675 |

FOREIGN PATENT DOCUMENTS

| | | | |
|---|---|---|---|
| JP | 11-219042 | A | 8/1999 |
| JP | 2004-053748 | A | 2/2004 |
| JP | 2010-002753 | A | 1/2010 |
| JP | 2019-191228 | A | 10/2019 |

* cited by examiner

*Primary Examiner* — William J Royer
(74) *Attorney, Agent, or Firm* — Venable LLP

(57) ABSTRACT

An image forming apparatus includes an image bearing member, a transfer member, a voltage applying portion applying a voltage to the transfer member, and a controller. The controller starts a control operation by applying a control voltage to the transfer member before a toner image is transferred to a transferred member from the image bearing member. On the basis of a coverage ratio indicating a ratio occupied by an image region per predetermined area regarding the toner image transferred to the transferred member from the image bearing member, the controller determines execution or non-execution of the control operation capable of being started before the toner image is transferred to the transferred member.

20 Claims, 13 Drawing Sheets

IMAGE FORMING APPARATUS CAPABLE OF SETTING TRANSFER VOLTAGE AND SUPPRESSING DETERIORATION OF MEMBERS DUE TO CONTROL OPERATION OF TRANSFER VOLTAGE

FIELD OF THE INVENTION AND RELATED ART

The present invention relates to an image forming apparatus, such as a copying machine, a printer, or a facsimile machine, of an electrophotographic type or an electrostatic recording type.

Conventionally, in an image forming apparatus using an electrophotographic type, etc., constant-current control or constant-voltage control is generally used for a transfer voltage applied to a transfer member which transfers a toner image from an image bearing member to a transferred member in a transfer portion. A transfer portion which transfers a toner image to a recording material such as a recording sheet as the transferred member from an image bearing member will be described further as an example.

In a case that the transfer voltage is controlled by constant-voltage control, a control as described below is carried out. As the transfer member, a transfer roller for example is used. This transfer roller is often used with an elastic layer which is formed of a material whose volume resistance is appropriately adjusted by dispersing a conductive agent such as a conductive particle in rubber. An electric resistance value of this type of material may vary over several orders of magnitude depending on an environment. Thus, in a case that a transfer voltage is not appropriate, a transfer failure may occur due to insufficient current in the transfer portion, or a transfer memory may occur due to excessive current flowing into the image bearing member in the transfer portion. Incidentally, "transfer memory" refers to a phenomenon in which an electric current history on an image bearing member is not completely removed and appears on a subsequent image.

Therefore, in order to apply a stable transfer voltage to the transfer portion regardless of the environment, ATVC (Auto Transfer Voltage Control) control is carried out. ATVC control, in general, is a control method which applies a test voltage to the transfer portion with constant-current control so that a predetermined target current value flows during pre-rotation when a recording material does not exist in the transfer portion, and sets a transfer voltage value during an image formation (during a transferring) based on a voltage value which is output from a transfer power source at that time. More specifically, a voltage value is calculated by adding a recording material shared voltage according to an electric resistance value of the recording material to a voltage output from the transfer power source (a member shared voltage) when the test voltage described above is applied, and constant-voltage control of the transfer voltage is carried out with the calculated voltage value during the image formation (during the transferring). In addition, after a leading end of the recording material with respect to a feeding direction enters the transfer portion, a control method that detects a leakage current and changes the transfer voltage before an image forming region of the recording material reaches the transfer portion also has been known (Japanese Laid-Open Patent Application (JP-A) Hei 11-219042).

In this way, conventionally, a control operation, which acquires information on electric properties of the transfer portion (voltage value generated when a predetermined current is applied, current value flowing when a predetermined voltage is applied, and electric resistance value) in order to set a transfer voltage before transferring a toner image, has been carried out.

By carrying out the control operation as described above, an effect of suppressing variations in transfer property due to environmental changes and differences in recording materials, etc. can be obtained.

SUMMARY OF THE INVENTION

However, a control operation of energizing the transfer portion to set a transfer voltage before transferring a toner image may accelerate deterioration of members such as the transfer roller and an intermediary transfer belt due to energization and rotation. Particularly, in a case that the image forming apparatus is used in a way that repeats print jobs with a relatively small number of prints, its effects are likely to be significant.

Thus, a principal object of the present invention is to provide an image forming apparatus capable of setting an appropriate transfer voltage and suppressing deterioration of members due to a control operation of a transfer voltage.

The object described above is achieved with the image forming apparatus of the present invention.

In summary, the present invention includes an image forming apparatus comprising an image bearing member configured to bear a toner image, a transfer member configured to form a transfer portion where the toner image is transferred from the image bearing member onto a transferred member, a voltage applying portion configured to apply a voltage to the transfer member, and a controller configured to be capable of starting a control operation by applying a control voltage to the transfer member before the toner image is transferred to the transferred member from the image bearing member, wherein on the basis of a coverage ratio indicating a ratio occupied by an image region per predetermined area regarding the toner image transferred to the transferred member from the image bearing member, the controller controls at least one of execution or non-execution of the control operation capable of being started before the toner image is transferred to the transferred member, operation setting of the control operation, and timing of transferring the toner image to the transferred member with respect to a period where the control operation is executed.

Further features of the present invention will become apparent from the following description of exemplary embodiments (with reference to the attached drawings).

DESCRIPTION OF THE EMBODIMENTS

An image forming apparatus according to the present invention will be described specifically with reference to the drawings.

(1) Image Forming Apparatus

Figure 1:
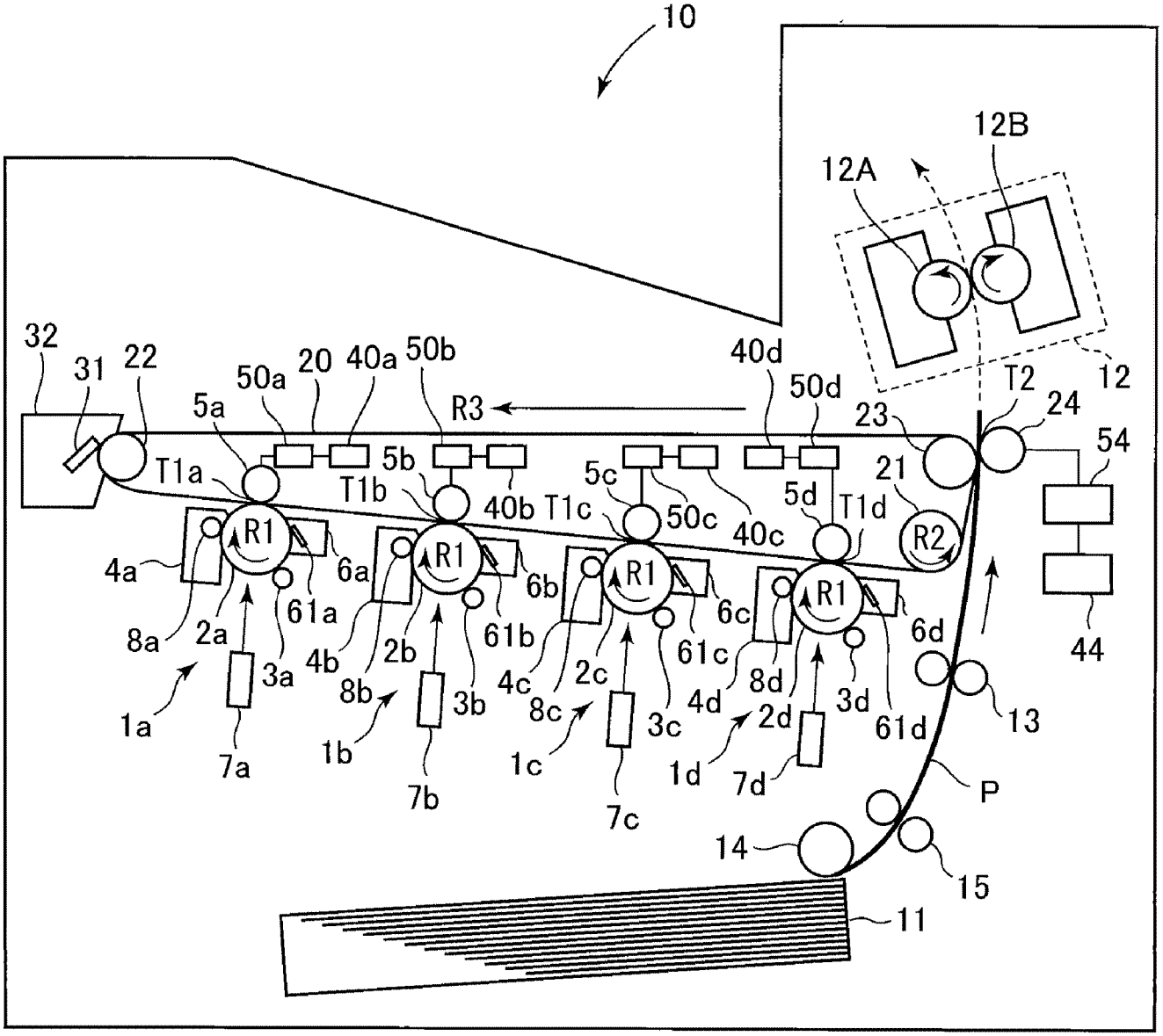
FIG. 1 is a schematic sectional view showing an image forming apparatus.

FIG. 1 is a schematic sectional view showing an image forming apparatus 10 of Embodiment 1. The image forming apparatus 10 of Embodiment 1 is a full-color laser beam printer capable of forming a full color image by using an electrophotographic type method and by employing an in-line type and an intermediary transfer type method.

The image forming apparatus 10 includes, as a plurality of image forming means, first to fourth image forming portions (stations) 1*a*, 1*b*, 1*c* and 1*d* for forming images of yellow (Y), magenta (M), cyan (C) and black (K), respectively. The image forming portions 1*a* to 1*d* are disposed in line at regular intervals. Elements which are provided for the respective colors and which have the same or corresponding functions or constitutions in the image forming portions 1*a* to 1*d* are collectively described in some instances by omitting suffixes a, b, c, and d for representing the elements for associated colors. In Embodiment 1, the image forming portion 1 is constituted by including a photosensitive drum 2 (2*a*, 2*b*, 2*c*, 2*d*), a charging roller 3 (3*a*, 3*b*, 3*c*, 3*d*), an exposure device 7 (7*a*, 7*b*, 7*c*, 7*d*), a developing device 4 (4*a*, 4*b*, 4*c*, 4*d*), a primary transfer roller 5 (5*a*, 5*b*, 5*c*, 5*d*), and a drum cleaning device 6 (6*a*, 6*b*, 6*c*, 6*d*). Incidentally, as regards magnitudes (high and low values) of a current and a voltage, for convenience, those in the case where absolute values thereof are compared with each other will be described.

The image forming apparatus 10 includes the photosensitive drum 2 which is a rotatable drum shaped (cylindrical) electrophotographic photosensitive member as a first image bearing member which bears a toner image. In Embodiment 1, the photosensitive drum 2 is a negatively chargeable OPC (organic photoconductor) photosensitive member and includes a drum base made of aluminum and a photosensitive layer formed on the drum base. The photosensitive drum 2 is rotationally driven at a predetermined peripheral speed (surface movement speed) in an arrow R1 direction (clockwise direction) in the figure by a driving device (not shown). In Embodiment 1, this peripheral speed of the photosensitive drum 2 corresponds to a process speed of the image forming apparatus 10. In Embodiment 1, a process speed of the image forming apparatus 10 is 210 mm/s. When an image formation start signal is sent, the photosensitive drum 2 is rotationally driven at a predetermined process speed.

A surface of the rotating photosensitive drum 2 is electrically charged uniformly to a predetermined polarity (negative in Embodiment 1) and a predetermined potential by the charging roller 3 which is a charging member of a roller type as a charging means. The charging roller 3 contacts the surface of the photosensitive drum 2 at a predetermined press contact force. During a charging step, to the charging roller 3, a predetermined charging voltage is applied by an unshown charging voltage source (high voltage source circuit) as a charging voltage application means.

The charged surface of the photosensitive drum 2 is subjected to scanning exposure depending on an image signal of a color component corresponding to the associated one of the image forming portions 1, by the exposure device (laser scanner device) 7 as an exposure means, so that on the photosensitive drum 2, an electrostatic latent image (electrostatic image) is formed. The exposure device 7 converts the image signal, of the color component corresponding to the image forming portion 1, inputted from an ASIC 314 (FIG. 2) (described later) into a light signal in a laser outputting portion. Then, the exposure device 7 subjects the uniformly charged surface of the photosensitive drum 2 to scanning exposure using laser light which is the converted light signal, so that the electrostatic latent image is formed on the photosensitive drum 2. In Embodiment 1, in the exposure device 7, the laser light modulated correspondingly to a time series electric digital pixel signal of image information inputted from a host computer 300 (FIG. 2) (described later) is outputted from the laser outputting portion. Then, in the exposure device 7, this laser light is emitted to the surface of the photosensitive drum 2 through a reflection mirror.

The electrostatic latent image formed on the photosensitive drum 2 is developed (visualized) with toner as a developer supplied by the developing device 4 as a developing means, so that a toner image (toner image, developer image) is formed on the photosensitive drum 2. In Embodiment 1, the developing device 4 is of a one component contact development type. The developing device 4 includes a developing roller 8 (8*a*, 8*b*, 8*c*, 8*d*) as a developer carrying member. The developing roller 8 carries thereon the toner in a thin layer shape and feeds the toner to a developing position opposing the photosensitive drum 2 by being rotationally driven by a driving device (not shown). Further, during a developing step, to the developing roller 8, a predetermined developing voltage is applied by an unshown developing voltage source (high voltage source circuit) as a developing voltage application means. As a result, the toner is electrostatically attracted to the surface of the photosensitive drum 2 depending on a surface potential of the photosensitive drum 2, so that the electrostatic latent image is developed into the toner image. In Embodiment 1, the toner charged to the same polarity (negative in Embodiment 1) as a charge polarity of the photosensitive drum 2 is deposited on an exposed portion (image portion) of the photosensitive drum 2 lowered in absolute value of the potential by the exposure to light after the photosensitive drum 2 is uniformly charged (reverse development type). In Embodiment 1, a normal charge polarity of the toner is a negative polarity, and the toner for forming the toner image principally includes negative electric charge. Incidentally, in the developing devices 4*a* to 4*d*, toners of colors of yellow, magenta, cyan and black are accommodated, respectively. In the operation in the full color image £described later), all the developing rollers 8 of the four developing devices 4 contact the photosensitive drum 2. Further, in the operation in the monochromatic mode (black single color mode in Embodiment 1) (described later), the developing rollers 8 of the developing devices 4 other than the developing device 4 of the image forming portion 1 (the image forming portion 1*d* for black in Embodiment 1) for forming the image are spaced from the photosensitive drum 2. This is because deterioration and consumption of the developing rollers 8 and the toners are suppressed.

An intermediary transfer belt 20 constituted by an endless belt as an intermediary transfer member is provided so as to oppose the four photosensitive drums 2*a* to 2*d*. The intermediary transfer belt 20 is extended and stretched with predetermined tension by, as a plurality of stretching rollers (supporting members), a driving roller 21, a cleaning opposite roller 22, and a secondary transfer opposite roller 23. The driving roller 21 is rotationally driven in an arrow R2 direction (counterclockwise direction) in the figure by a driving device (not shown), so that the intermediary transfer belt 20 is rotated (circulated and moved) at a speed substantially equal to the peripheral speed of the photosensitive drum 2, i.e., the predetermined process speed in an arrow R3 direction (counterclockwise direction). In an inner peripheral surface (back surface) side of the intermediary transfer belt 20, primary transfer rollers 5*a* to 5*d* which are roller type primary transfer members as primary transfer means are provided correspondingly to the respective photosensitive drums 2*a* to 2*d*. Each primary transfer roller 5 presses the intermediary transfer belt 20 toward the associated photosensitive drum 2 and forms a primary transfer portion (primary transfer nip) T1 (T1*a*, T1*b*, T1*c*, T1*d*) where the photosensitive drum 2 and the intermediary transfer belt 20 are in contact with each other. As described above, the toner image formed on the photosensitive drum 2 is primary transferred, at the primary transfer portion T1, onto the intermediary transfer belt 20 rotating as a transferred member by the action of the primary transfer roller 5. During a primary transfer step, to the primary transfer roller 5, a primary transfer voltage, which is a DC voltage of an opposite polarity (positive polarity in Embodiment 1) to the normal charge polarity of the toner, is applied by a primary transfer voltage source (high voltage source circuit) 40 (40*a*, 40*b*, 40*c*, 40*d*) as a primary transfer voltage application means. For example, during full color image formation, the toner images of the respective colors of yellow, magenta, cyan and black formed on the respective photosensitive drums 2*a* to 2*d* are successively primary transferred superposedly onto the intermediary transfer belt 20.

In an outer peripheral surface (front surface) side of the intermediary transfer belt 20, at a position opposing the secondary transfer opposite roller 23, a secondary transfer roller (outer roller) 24, which is a roller type secondary transfer member as a secondary transfer means, is provided. The secondary transfer roller 24 is urged toward and contacted to the secondary transfer opposite roller 23 via the intermediary transfer belt 20, and forms a secondary transfer portion (secondary transfer nip) T2 where the intermediary transfer belt 20 and the secondary transfer roller 24 are in contact with each other. The toner images formed on the intermediary transfer belt 20 are secondary transferred, at the secondary transfer portion T2, onto a recording material P such as paper as a transferred member sandwiched and fed by the intermediary transfer belt 20 and the secondary transfer roller 24 by the action of the secondary transfer roller 24. During a secondary transfer step, to the secondary transfer roller 24, a secondary transfer voltage which is a DC voltage of an opposite polarity (positive polarity in Embodiment 1) to the normal charge polarity of the toner is applied by a secondary transfer voltage source (high voltage source circuit) 44 as a secondary transfer application means (secondary transfer voltage application portion). The recording material (transfer material, sheet) P is accommodated in a cassette 11 as a recording material accommodating portion. The recording material P is fed from the cassette 11 by a feeding roller 14 as a sheet feeding member and is conveyed to a registration roller pair 13 by a conveying roller pair 15 as a feeding member. The recording material P is fed by the registration roller pair 13 as a feeding member to the secondary transfer portion T2 in synchronism with timing when a leading end of the toner image on the intermediary transfer belt 20 moves to the secondary transfer portion T2. The feeding roller 14, the conveying roller pair 15 and the registration roller pair 13 constitute a recording material supplying means.

The recording material P on which the toner images are transferred is fed to a fixing device 12 as a fixing means. The fixing device 12 includes a fixing roller 12A provided with a heat source and a pressing roller 12B press contacting the fixing roller 12A. The fixing device 12 feeds the recording material P on which the unfixed toner images are carried and fixes the unfixed toner images on the recording material P while heating and pressing the recording material P by the fixing roller 12A and the pressing roller 12B. The recording material P on which the toner images are fixed is discharged (outputted) to an outside of a main assembly of the image forming apparatus 10.

Further, the toner (primary transfer residual toner) remaining on the surface of the photosensitive drum 2 after the primary transfer step is removed and collected from the surface of the photosensitive drum 2 by a drum cleaning device 6 as a photosensitive member cleaning means. The drum cleaning device 6 includes a drum cleaning blade 61 (61*a*, 61*b*, 61*c*, 61*d*), which is a plate like member formed by an elastic member such as a urethane rubber, as a cleaning member and includes a collected toner container. The drum cleaning device 6 scrapes off the primary transfer residual toner from the surface of the rotating photosensitive drum 2 by the drum cleaning blade 61 contacting the surface of the photosensitive drum 2 and then the primary transfer residual toner is accommodated in the collected toner container. Further, in the outer peripheral surface side of the intermediary transfer belt 20, at a position opposing a cleaning opposite roller 22, a belt cleaning device 32 as an intermediary transfer member cleaning means is provided. The toner (secondary transfer residual toner) remaining on the surface of the intermediary transfer belt 20 after the secondary transfer step is removed and collected from the surface of the intermediary transfer belt 20 by the belt cleaning device 32. The belt cleaning device 32 includes a cleaning blade 31, which is a plate like member formed by an elastic member such as a urethane rubber, as a cleaning member and includes a collected toner container. The belt cleaning device 32 scrapes off the secondary transfer residual toner from the surface of the rotating intermediary transfer belt 20 by the cleaning blade 31 contacting the intermediary transfer belt 20 and then the secondary transfer residual toner is accommodated in the collected toner container.

In Embodiment 1, in each image forming portion 1, the photosensitive drum 2 and, as process means actable thereon, the charging roller 3, the developing device 4 and the drum cleaning device 6 integrally constitute a process cartridge detachably mountable to the main assembly of the image forming apparatus 10. The process cartridge is exchanged to a new one, for example, in the case where the toner in the developing device 4 is used up or in the case where the photosensitive drum 2 reaches an end of its lifetime.

Further, in Embodiment 1, the intermediary transfer belt 20, the respective stretching rollers 21, 22 and 23, the respective primary transfer rollers 5, and the belt cleaning device 32 integrally constitute an intermediary transfer belt unit detachably mountable to the main assembly of the image forming apparatus 10. The intermediary transfer belt unit is exchanged with a new one, for example, in the case where the intermediary transfer belt 20 reaches an end of its lifetime.

In Embodiment 1, the image forming apparatus 10 is operable in, as a printing mode (image forming mode), the full color mode and the monochromatic mode (block black single color mode in Embodiment 1). In the full color image mode, images are formed in all four image forming portions 1*a* to 1*d*, so that a full color image can be formed. In Embodiment 1, in the monochromatic mode, an image is formed only in the image forming portion 1*d* for black of the four image forming portions 1*a* to 1*d*, so that a black single color image can be formed. In the monochromatic mode, in the image forming portions 1 other than the image forming portion 1*d* for forming the black image, the primary transfer rollers 5 are spaced from the intermediary transfer belt 20, so that the intermediary transfer belt 20 is spaced from the photosensitive drums 2. Further, in the monochromatic mode, in the image forming portions 1 other than the image forming portion 1*d* for black, drive of the photosensitive drums 2 and the developing rollers 8 is stopped and the developing rollers 8 are spaced from the photosensitive drum 2. Incidentally, in the monochromatic mode, in the image forming portions 1 other than the image forming portion 1*d*, the primary transfer voltage source 40 does not apply the voltage to the primary transfer roller 5.

(2) Transfer Constitution

In Embodiment 1, as a base resin material of a base material of the intermediary transfer belt 20, a polyethylene naphthalate (PEN) resin material was used. Incidentally, as the base resin material of the base material of the intermediary transfer belt 20, for example, it is possible to cite thermoplastic resin materials such as polycarbonate, polyvinylidene fluoride (PVDF), polyethylene, polypropylene, polymethylpentene-1, polystyrene, polyamide, polysulfone, polyalylate, polyethylene terephthalate, polyethylene naphthalate, polybutylene naphthalate, polybutylene naphthalate, polyphenylene sulfide, polyether sulfone, polyether nitrile, thermoplastic polyimide, polyether ether ketone, thermotropic liquid crystal polymer, and polyamide acid. Two or more species of these resin material can also be used in mixture.

Further, in Embodiment 1, the base material of the intermediary transfer belt 20 contains an electroconductive agent having an ion-conductive property in order to impart electroconductivity to the intermediary transfer belt 20. By employing an ion-conductive intermediary transfer belt 20 containing the electroconductive agent having the ion-conductive property, compared with the case where an electron-conductive intermediary transfer belt 20 containing an electroconductive agent having an electron-conductive property is used, a manufacturing tolerance of an electric resistance of the intermediary transfer belt 20 can be suppressed to a low level.

As the electroconductive agent having the ion-conductive property, it is possible to cite a multivalent metal salt and a quaternary ammonium salt, etc. As regards the quaternary ammonium salt, as a cationic portion, it is possible to cite tetraethylammonium ion, tetrapropylammonium ion, tetraisopropylammonium ion, tetrabutyl ammonium ion, tetrapentylammonium ion, tetrahexylammonium ion, and the like, and as an anionic portion, it is possible to cite halogen ion, and fluoroalkylsulfate ion, fluoroalkylsulfide ion, fluoroalkylborate ion which have 1-10 carbon atoms, and the like ions.

Further, as the electroconductive agent having the ion-conductive property, an ionic liquid may also be used. The ionic liquid is a liquid consisting only of an ion, and refers to a salt which exists as a liquid in a wide temperature range, and which has a melting point of particularly 100° C. or less. As an anionic species constituting the ionic liquid, it is possible to cite sulfonylimide ion, and the like ions, and as a cationic species constituting the ionic liquid, it is possible to cite ammonium based ion, imidazolium based ion, pyridium based ion, piperidinum based ion, pyrrolinium based ion, phosphonium based ion, and the like ion.

The ingredients described above are melt kneaded, and then, a molding method such as inflation molding, cylindrical extrusion molding or injection stretch-blow molding is appropriately selected, so that the intermediary transfer belt 20 as a resin composition can be obtained.

The intermediary transfer belt 20 may also include another layer by providing a protective layer on the surface of the base material (base layer) described above. That is, the intermediary transfer belt 20 may only be required to contain a layer formed of an electroconductive member having the ion-conductive property.

Incidentally, the intermediary transfer belt 20 in Embodiment 1 has surface resistivity of $8.0\times10^{9}$ Ω/sq and volume resistivity of $5.0\times10^{9}$ Ωcm. The values of the resistivity were measured at an applied voltage of 250 V by using a resistivity meter, "Hiresta UP" manufactured by Nittoseiko Analytech Co., Ltd. and a measuring electrode, "URS probe" which is a dedicated probe for "Hiresta UP".

As the primary transfer roller 5, for example, it is possible to use a metal roller, an elastic roller provided with a layer (elastic layer) of an elastic member such as a sponge rubber, and the like roller. In Embodiment 1, as the primary transfer roller 5, an elastic roller prepared by coating a 3.7 mm thick NBR hydrin rubber on a nickel plated steel rod of 6 mm in diameter. An electric resistance value of the primary transfer roller 5 in Embodiment 1 is $3.0\times10^{5}$Ω in the case where a voltage of 50 V is applied to an aluminum cylinder in a state in which the primary transfer roller 5 is pressed against the aluminum cylinder at a pressure of 4.9 N and in which the aluminum cylinder is rotated at a peripheral speed of 50 mm/sec, under condition that a temperature is 23° C. and a relative humidity is 50% RH. The material of the elastic layer of the primary transfer roller 5 is dispersed with ionic and electronic conductive agents to adjust the electric resistance. Further, in Embodiment 1, the primary transfer roller 5 is disposed downstream of the photosensitive drum 2 with respect to a feeding direction (surface movement direction, rotational direction) of the intermediary transfer belt 20 by being offset by 1.5 mm. Further, the primary transfer roller 5 presses the intermediary transfer belt 20 from the inner peripheral surface (back surface) side toward the outer peripheral surface (front surface) side, and the outer peripheral surface of the intermediary transfer belt 20 is contacted to an outer peripheral surface (front surface) of the photosensitive drum 2, so that the primary transfer portion T1 is formed between the intermediary transfer belt 20 and the photosensitive drum 2. In an operation in the full-color image, all four primary transfer rollers 5*a* to 5*d* contact the intermediary transfer belt 20. Further, in an operation in the monochromatic mode (a black single color mode in this embodiment), the primary transfer rollers 5 other than the primary transfer roller 5 of the image forming portion 1 which forms an image (the image forming portion 1*d* for black in Embodiment 1) are spaced from the intermediary transfer belt 20. The primary transfer roller 5 is rotated with movement of the intermediary transfer belt 20.

To the primary transfer roller 5, the primary transfer voltage source 40 as a primary transfer voltage application means and a primary transfer current detecting portion (primary transfer current detecting circuit) 50 (50*a*, 50*b*, 50*c*, 50*d*) as a primary transfer control detecting means are connected. To the primary transfer roller 5, a primary transfer voltage is applied from the primary transfer voltage source 40. The primary transfer voltage source 40 is capable of selectively applying a positive polarity voltage and a negative polarity voltage to the primary transfer roller 5. The primary transfer current detecting portion 50 detects a current flowing through the primary transfer roller 5 (primary transfer portion T1, primary transfer voltage source 40) when the primary transfer voltage source 40 applies a voltage to the primary transfer roller 5 (primary transfer portion T1). The primary transfer voltage current detecting portion 50 is capable of outputting a signal showing a detection result of the current to an engine controller 302 (FIG. 2) (described later). Further, in Embodiment 1, the primary transfer voltage source 40 is capable of subjecting the primary transfer roller 5 to constant-current control and constant-voltage control of the voltage applied to the primary transfer roller 5. That is, the primary transfer voltage source 40 is capable of carrying out the constant-current control of the voltage applied to the primary transfer roller 5 by adjusting output of the voltage so that the current detected by the primary transfer current detecting portion 50 becomes substantially constant (approaches a target current value). Further, the primary transfer voltage source 40 is capable of carrying out the control-voltage control of the voltage applied to the primary transfer roller 5 by adjusting the output of the voltage so as to become substantially constant (so as to approach a target voltage value). The primary transfer voltage source 40 may include, as a primary transfer voltage detecting means, a primary transfer voltage detecting portion (primary transfer voltage detecting circuit) for detecting the voltage applied to the primary transfer roller 5 or may also be capable of detecting the voltage value from a set value of the output voltage. The primary transfer voltage source 40 is capable of outputting a signal showing a detection result of the voltage to the engine controller 302 (FIG. 2) (described later).

As the secondary transfer roller 24, for example, it is possible to use an elastic roller provided with a layer (elastic layer) of an elastic member such as a sponge rubber, and the like roller. In Embodiment 1, as the secondary transfer roller 24, an elastic roller is prepared by coating a 6 mm thick NBR hydrin rubber as an elastic layer on a nickel plated steel rod of 8 mm in diameter. An electric resistance value of the secondary transfer roller 24 in Embodiment 1 is $3.0\times10^7\Omega$ in the case where a voltage of 1000 V is applied to an aluminum cylinder in a state in which the secondary transfer roller 24 is pressed against the aluminum cylinder at a pressure of 9.8 N and in which the aluminum cylinder is rotated at a peripheral speed of 50 mm/sec, under condition that a temperature is 23° C. and a relative humidity is 50% RH. The material of the elastic layer of the secondary transfer roller 24 is dispersed with ionic and electronic conductive agents to adjust the electric resistance. Further, the secondary transfer roller 24 contacts the intermediary transfer belt 20 toward the secondary transfer opposite roller 23, so that the secondary transfer portion T2 is formed at the contact portion between the intermediary transfer belt 20 and the secondary transfer roller 24. The secondary transfer roller 24 is rotated with movement of the intermediary transfer belt 20 or the recording material P.

To the secondary transfer roller 24, the secondary transfer voltage source 44 as a secondary transfer voltage application means and a secondary transfer current detecting portion (secondary transfer current detecting circuit) 54 as a secondary transfer control detecting means are connected. To the secondary transfer roller 24, a secondary transfer voltage is applied from the secondary transfer voltage source 44. The secondary transfer voltage source 44 is capable of selectively applying a positive polarity voltage and a negative polarity voltage to the secondary transfer roller 24. The secondary transfer current detecting portion 54 detects a current flowing through the secondary transfer roller 24 (secondary transfer portion T2, secondary transfer voltage source 44) when the secondary transfer voltage source 44 applies a voltage to the secondary transfer roller 24 (secondary transfer portion T2). The secondary transfer current detecting portion 54 is capable of outputting a signal showing a detection result of the current to an engine controller 302 (FIG. 2) (described later). Further, in Embodiment 1, the secondary transfer voltage source 44 is capable of subjecting the secondary transfer roller 24 to constant-current control and constant-voltage control of the voltage applied to the secondary transfer roller 24. That is, the secondary transfer voltage source 44 is capable of carrying out the constant-current control of the voltage applied to the secondary transfer roller 24 by adjusting output of the voltage so that the current detected by the secondary transfer current detecting portion 54 becomes substantially constant (approaches a target current value). Further, the secondary transfer voltage source 44 is capable of carrying out the constant-voltage control of the voltage applied to the secondary transfer roller 24 by adjusting the output of the voltage so as to become substantially constant (so as to approach a target voltage value). The secondary transfer voltage source 44 may include, as a secondary transfer voltage detecting means, a secondary transfer voltage detecting portion (secondary transfer voltage detecting circuit) for detecting the voltage applied to the secondary transfer roller 24 or may also be capable of detecting the voltage value from a set value of the output voltage. The secondary transfer voltage source 44 is capable of outputting a signal showing a detection result of the voltage to the engine controller 302 (FIG. 2) (described later). Incidentally, in Embodiment 1, the secondary transfer opposite roller 23 is electrically grounded (connected to a ground).

(3) Control Mode

Figure 2:
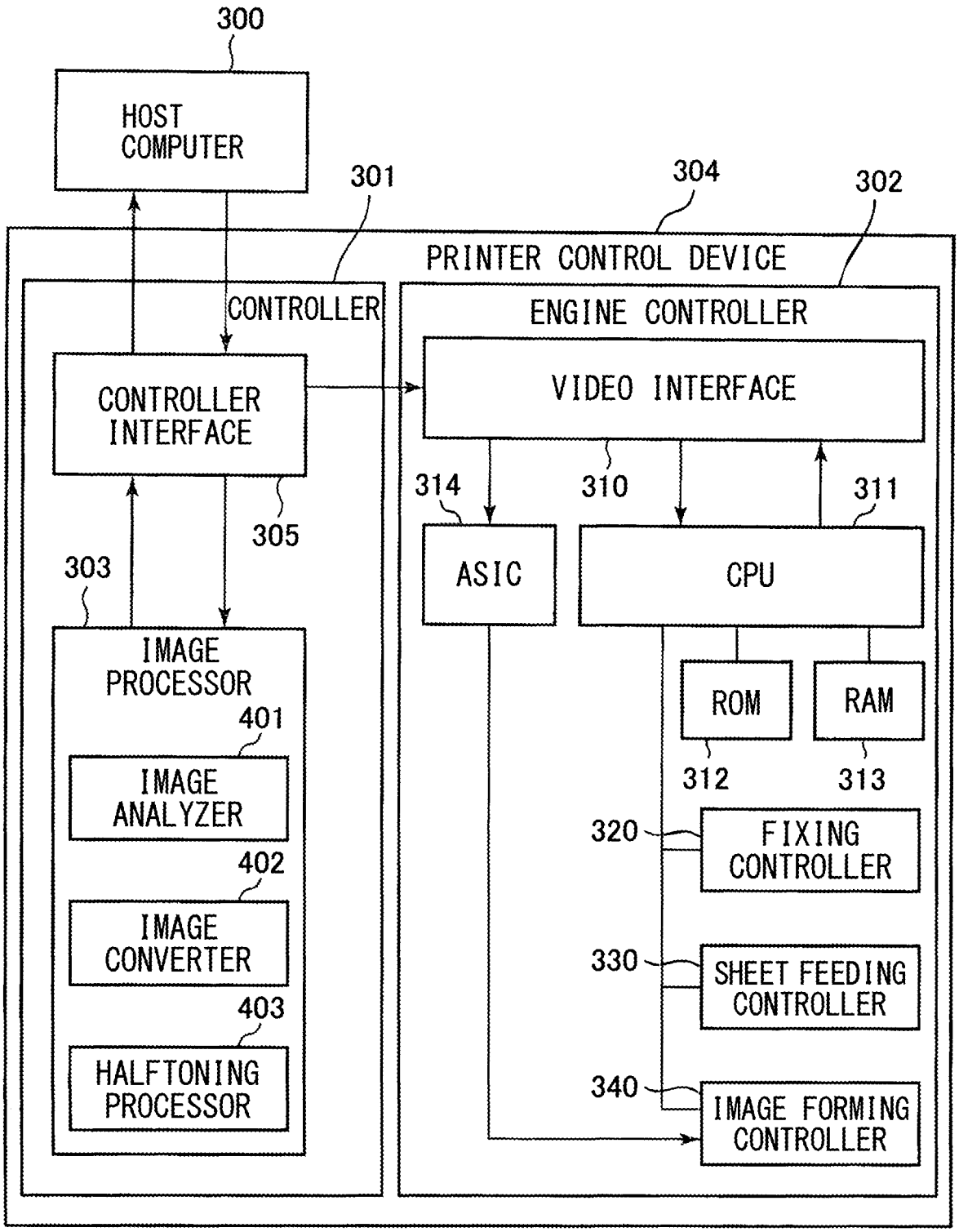
FIG. 2 is a block diagram showing a system configuration of a printer control device.

FIG. 2 is a schematic block diagram showing a system constitution of the printer control system of Embodiment 1. The image forming apparatus 10 includes a printer control device 304. The printer control device 304 roughly includes a controller 301 and the engine controller 302. The printer control device 304 is connected to the host computer 300, which is an external device, by using a controller interface 305 of the controller 301, and establishes communication with the host computer 300. In the controller 301, on the basis of information received from the host computer 300, an image processing portion processor 303 performs bit mapping of character code and half toning processing of a gray scale image, etc. Further, the controller 301 sends image information to the engine controller 302 through a video interface 310. This image information contains information for controlling turning on timing of the exposure device 7, information on the printing mode (including recording material information described later) for controlling a process condition such as a control temperature of the fixing device 12, image size information, and the like.

The turning on timing information of the exposure device 7 is sent from the controller portion 301 to the ASIC (Application Specific Integrated Circuit) 314. The ASIC 314 controls a part of the image forming portion 1, such as the exposure device 7, controlled by an image forming controller 340.

On the other hand, pieces of information such as the information on the printing mode and the image size information are sent to a CPU (Central Processing Unit) 311 as a control means. The CPU 311 carries out heating control of the fixing device 12 at a fixing controller 320, operation interval control of the feeding roller 14 at a sheet feeding controller 330, and control of the process speed, development/charging/transfer at the image forming controller 340. In such control, as desired, the CPU 311 stores the information in a RAM 313 as a storing means. Further, the CPU 311 uses programs stored in a ROM 312 and the RAM 313 which are storing means. Further, the CPU 311 makes reference to information (including a calculation result, detection results of various sensors, and the like) stored in the ROM 312 or the RAM 313.

Further, depending on an instruction inputted on the basis of an operation performed on the host computer 300 by an operator such as a user or a service person, the controller 301 sends a printing instruction, a cancel instruction, and the like to the engine controller 302. As a result, the controller 301 controls operations such as a start, a stop, and the like of a printing operation (image forming operation, printing operation).

Here, the image forming apparatus 10 performs a printing job which is a series of image forming operations which is started by a start instruction and in which an image is formed on a single or a plurality of recording materials P and then is outputted. The printing job generally includes an image forming step, a pre-rotation step, a sheet interval step in the case where the image is formed on the plurality of the recording materials P, and a post-rotation step. The image forming step is a period in which formation of the electrostatic image for an image formed and outputted on the recording material P, formation of the toner image, and primary transfer and secondary transfer of the toner image are performed, and "during image formation" refers to this period. Specifically, timing during the image formation is different at positions where the respective steps including the formation of the electrostatic image, the formation of the toner image, and the primary transfer and the secondary transfer of the toner image are performed, and corresponds to a period in which an image region on the photosensitive drum 2 or the intermediary transfer belt 20 passes through one of the positions described above. The pre-rotation step is a period in which a preparatory operation, from input of the start instruction until the image formation is actually started, before the image forming step is performed. The sheet interval step is a period corresponding to an interval between a recording material P and a subsequent recording material P when image formation on a plurality of recording materials P is continuously performed (continuous image formation) with respect to the plurality of recording materials P. The post-rotation step is a period in which a post operation (preparatory operation) after the image forming step is performed. "During non-image formation" refers to a period other than "during image formation", and includes the pre-rotation step, the sheet interval step, the post-rotation step and further includes a pre multi rotation step which is a preparatory operation during main switch actuation of the image forming apparatus 10 or during restoration from a sleep state. Specifically, timing of during non-image formation corresponds to a period in which a non-image region on the photosensitive drum 2 or the intermediary transfer belt 20 passes through one of positions where steps of secondary transfer, such as formation of the electrostatic image, formation of the toner image, primary transfer of the toner image and secondary transfer of the toner image, which are described above, are carried out. Incidentally, the image region on the photosensitive drum 2 or the intermediary transfer belt 20 refers to a region where the image is transferred on the recording material P, and the non-image region refers to a region other than the image region.

(4) Control Method of Secondary Transfer Voltage

<Normal Printing Operation>

Next, a control method of the secondary transfer voltage in this embodiment will be described. In Embodiment 1, in order to secondary transfer the toner image from the intermediary transfer belt 20 onto the recording material P, a secondary transfer voltage of a positive polarity is applied from the secondary transfer voltage source 44 to the secondary transfer roller 24.

Figure 3:
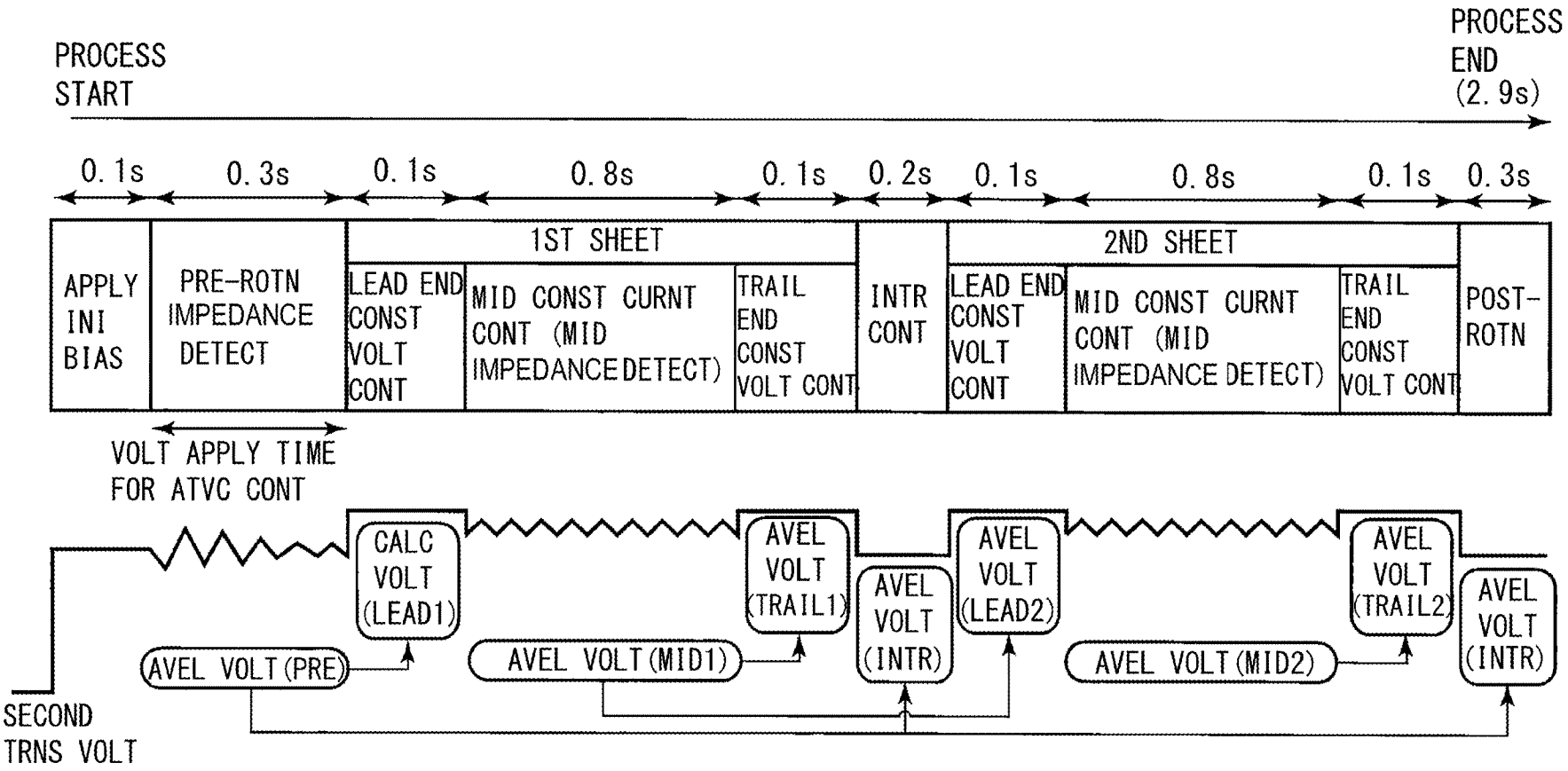
FIG. 3 is a chart showing a timeline of a secondary transfer voltage in a case of printing on two sheets of A4 paper with ATVC control.

With reference to FIG. 3, the timeline of the secondary transfer voltage in the case that printing is performed with ATVC control normally in the image forming apparatus 10 of Embodiment 1 will be described. FIG. 3 is the chart showing the timeline of the secondary transfer voltage in the case that printing is performed on two sheets of A4 paper (210 mm horizontal feeding) as the recording material P with ATVC control normally. This control of the secondary transfer voltage is performed by the CPU 311. Incidentally, the passing of the recording material P through the secondary transfer portion T2 is also referred to as "sheet passing".

First, when the printing job process starts, an initial bias of the secondary transfer voltage is applied to the secondary transfer roller 24 from the secondary transfer voltage source 44 under constant-voltage control. The initial bias is intended to stabilize a voltage behavior before sheet passing, and it stabilizes in 0.1 s after startup. As regards the initial bias voltage value, a predetermined value is selected so as to obtain an optimum transfer property depending on environment information which is information on an environment (at least one of a temperature and a humidity), recording material information which is information regarding the recording material P, information on the printing mode, and the like information. That is, in the ROM 312, information on the initial bias voltage value, which is predetermined depending on the environmental information, the recording material information, the printing mode information, and the like information, is stored. Further, the image forming apparatus 10 is provided with an environmental sensor (not shown) constituted by, for example, a temperature/humidity sensor as an environment detecting means for detecting at least one of the temperature and the humidity of at least one of an inside and an outside of the image forming apparatus 10. The CPU 311 is capable of acquiring the environmental information from this environmental sensor. Further, the CPU 311 is capable of acquiring the recording material information contained in the printing job information inputted from the host computer 300 through the controller 301. Incidentally, the information (recording material information) regarding the recording material P embraces arbitrary information capable of discriminating the recording material P, such as attributes (so called paper kind categories) based on general features inclusive of plain paper, high-quality paper, glossy paper, coated paper, embossed paper, thick paper, thin paper, paper quality and the like, numerals or numerical ranges inclusive of a basis weight, a thickness, a size, a stiffness and the like, and brands (inclusive of manufacturers, product names and product numbers). Each of the recording material P, discriminated by information regarding the recording material P, can be considered as constituting the kind of the recording material P. Further, the CPU 311 is capable of acquiring information on the printing mode (full color mode, monochromatic mode, and the like) contained in the printing job inputted from the host computer 300 through the controller 301. Accordingly, on the basis of the acquired pieces of information such as the environmental information, the recording material information, the printing mode information and the like information described above, the CPU 311 is capable of selecting a corresponding value from the initial bias voltage values which are stored in the ROM 312 and predetermined. Incidentally, the information regarding the recording materials P may be included in the printing mode information which specifies the operation settings of the image forming apparatus 10, such as "plain paper mode", "thick paper mode" and the like or substituted for the printing mode information. Further, some or all of the printing job information may be input to the CPU 311 from an operation portion (not shown) which is equipped with a display means and an input means in the image forming apparatus 10.

Next, pre-rotation impedance detecting is carried out. The purpose of this detecting is to detect the voltage value at which a current of a predetermined target current value (first target current value) is flowing during pre-rotation when there is no recording material P in the secondary transfer portion T2. That is, the secondary transfer voltage source 44 detects the voltage value of the voltage output from the secondary transfer voltage source 44, when a test voltage (control voltage) is applied from the secondary transfer voltage source 44 to the secondary transfer roller 24 with constant-current control so that a current of the first target current value flows during pre-rotation. It is desirable to acquire a detection result for at least one revolution of the secondary transfer roller 24, in order to obtain an accurate voltage value. In Embodiment 1, the diameter of the secondary transfer roller 24 is 20 mm. Thus, a moving distance (distance of voltage application) of the secondary transfer roller 24 during applying the test voltage, which corresponds to one revolution of the secondary transfer roller 24, is approximately 63 mm. Further, in Embodiment 1, a process speed of the image forming apparatus 10 is 210 mm/s. Thus, an application time of the test voltage (voltage application time) corresponding to one revolution of the secondary transfer roller 24 is 0.3 s. Based on the detection result of this voltage value, the CPU 311 calculates an average voltage value (pre), which is an average value of the voltage value at which the current of the first target current value flows. This average voltage value (pre) is also employed as the average voltage value (interval), which is the voltage value of the voltage applied from the secondary transfer voltage source 44 to the secondary transfer roller 24 with constant-voltage control during the paper interval and the post-rotation, as shown in the timeline. In Embodiment 1, the moving distance (sheet interval length) of the secondary transfer roller 24 during sheet interval is 42 mm, and the moving distance (length of post-rotation) of the secondary transfer roller 24 during rear rotation is 63 mm. Then, the CPU 311 calculates the voltage value (leading 1), which is the voltage value obtained by adding a voltage value for a divided voltage of the recording material P to the average voltage value (pre) described above. The first target current value described above is selected from predetermined values in order to obtain an optimum transfer property depending on the environmental information, the recording material information, the printing mode information and the like information. Further, the voltage value for the divided voltage of the recording material P (recording material shared voltage value) described above is selected from predetermined values in order to obtain an optimum transfer property depending on the environmental information, the recording material information, the printing mode information, and the like information. That is, in the ROM 312, information on the first target current value and the recording material shared voltage value, predetermined depending on the environmental information, the recording material information, the printing mode information, and the like information is stored. The CPU 311 is capable of selecting a corresponding one from the first target current value and the recording material shared voltage value stored in the ROM 312 and predetermined, respectively, depending on the environmental information, the recording material information, the printing mode information, and the like information obtained in the same way as described above. Incidentally, the voltage value (leading 1) can be determined by adding the recording material shared voltage value to the voltage value determined by equaling, multiplying by coefficient times, adding a constant voltage or the like calculation to the average voltage value (pre) (these may be used alone or in combination). In Embodiment 1, by adding the recording material shared voltage value to the same value as the average voltage value (pre), the voltage value (leading 1), which is the target voltage value of the secondary transfer voltage for a leading end portion of a first sheet of recording material P (furthermore, during sheet interval and during post-rotation), was calculated.

Here, the impedance of the secondary transfer portion T2 tends to change significantly before and after the leading end of the recording material P with respect to the feeding direction enters the secondary transfer portion T2 and before and after the trailing end portion of the recording material P with respect to the feeding direction leaves the secondary transfer portion T2. Thus, in the case that the secondary transfer voltage is controlled by a constant-current control during these periods, the transfer current and the transfer voltage may fluctuate greatly, and the transfer property may not be stable, or the transfer memory may occur. Therefore, in Embodiment 1, the constant-voltage control of the secondary transfer voltage is carried out at the leading end portion and the trailing end portion with respect to the feeding direction of the recording material P, and the constant-current control of the secondary transfer voltage is carried out at the other portion.

Incidentally, the leading end portion of the recording material P with respect to the feeding direction (hereinafter referred to simply as "leading end portion" or "leading end of sheet") is a predetermined width portion of the recording material P from the leading end toward the trailing end side with respect to the feeding direction. The width of the leading end portion of the recording material P with respect to the transport direction of the recording material P can be set appropriately to sufficiently suppress defects which may occur in the case that the secondary transfer voltage is controlled by the constant-current control as described above. However, typically, the width of the leading end portion of this recording material P is often sufficient to be less than the length of one revolution of the secondary transfer roller 24. In Embodiment 1, the width of the leading end portion of this recording material P is 21 mm (approximately one third of the length of one revolution of the secondary transfer roller 24). Further, the trailing end portion of the recording material P with respect to the feeding direction (hereinafter referred to simply as "trailing end portion" or "trailing end of sheet") is a predetermined portion of a predetermined width from the trailing end toward the leading end side with respect to the feeding direction of the recording material P. The width of the trailing end portion of the recording material P with respect to the feeding direction of the recording material P can be set appropriately to sufficiently suppress defects which may occur in the case that the secondary transfer voltage is controlled by the constant-current control as described above. However, typically, the width of the trailing end portion of this recording material P is often sufficient to be less than the length of one revolution of the secondary transfer roller 24. In Embodiment 1, the width of the trailing end portion of this recording material P is 21 mm (approximately one third of the length of one revolution of the secondary transfer roller 24).

Next, once a first sheet of the recording material P reaches the secondary transfer portion T2, while the leading end portion of the recording material P is passing through the secondary transfer portion T2, the secondary transfer voltage controlled by the constant-voltage control at the voltage value described above (leading 1) is applied from the secondary transfer voltage source 44 to the secondary transfer roller 24.

Next, once a portion between the leading end portion and the trailing end portion of the first sheet of the recording material P (hereinafter referred to simply as "middle portion" or "middle of sheet") reaches the secondary transfer portion T2, while the middle portion of the recording material P is passing through the secondary transfer portion T2, the secondary transfer voltage controlled by the constant-current control at the predetermined target current value (second target current value) is applied from the secondary transfer voltage source 44 to the secondary transfer roller 24. As regards the second target current value, a predetermined value is selected so as to obtain an optimum transfer property depending on the environment information, the recording material information, the information on the printing mode, and the like information. That is, in the ROM 312, information on the second target current value determined in advance depending on the environment information, the recording material information, the printing mode information, and the like information is stored. On the basis of the environmental information, the recording material information, the printing mode information and the like information which are acquired in the same way as described above, the CPU 311 is capable of selecting a corresponding one from the second target current values which are stored in the ROM 312 and which are determined in advance.

Next, once the trailing end portion of the first sheet of the recording material P reaches the secondary transfer portion T2, while the trailing end portion of the recording material P is passing through the secondary transfer portion T2, the secondary transfer voltage controlled by the constant-voltage control at an average voltage value as will be described below (trailing 1) is applied from the secondary transfer voltage source 44 to the secondary transfer roller 24. That is, by carrying out the constant-current control of the secondary transfer voltage for the middle portion of the first sheet of recording material P, information on the accurate voltage value at which the current of the second target current value described above flows can be obtained. Therefore, in Embodiment 1, the CPU 311 calculates the average voltage value (middle 1), which is an average of voltage values during the constant-current control of the secondary transfer voltage for the middle portion of the first sheet of the recording material P. This average voltage value (middle 1) is employed as the average voltage value (trailing 1), which is the target voltage value of the secondary transfer voltage for the trailing end portion of the first sheet of the recording material P, and the average voltage value (leading 2), which is the target voltage value of the secondary transfer voltage for the leading end portion of the second sheet of recording material P.

Finally, even while the middle portion of the second sheet of the recording material P is passing through the secondary transfer portion T2, the secondary transfer voltage is applied from the secondary transfer voltage source 44 to the secondary transfer roller 24 with the constant-current control in the same way as the first sheet. Then, the average voltage value (middle 2) during the constant-current control of the secondary transfer voltage for the middle portion of the second sheet of the recording material P is employed as the average voltage value (trailing 2), which is the target voltage value of the secondary transfer voltage for the trailing end portion of the second sheet of the recording material P. This is in order to employ a more accurate voltage value as the target voltage value, with consideration of differences (differences in electric resistance) of each recording material P.

What described above is the timeline of the secondary transfer voltage in the case that printing is performed with ATVC control normally.

<Principle of Control in Embodiment 1>

As described above, in Embodiment 1, ATVC control is performed to determine the target voltage value (constant voltage value) of the secondary transfer voltage for the leading end portion of the first sheet of the recording material P, as well as the target voltage value during sheet interval and post-rotation. As for the target voltage value during sheet interval and post-rotation, it may be controlled within a range which does not cause defects such as a transfer memory due to an abnormal current flow. However, as for the target voltage value of the secondary transfer voltage for the leading end portion of the first sheet of the recording material P, it directly affects an image quality, so it is desirable to determine it accurately in order to obtain optimum transfer property.

However, when ATVC control is performed every time a printing job is executed, deterioration of members such as the secondary transfer roller 24 and the intermediary transfer belt 20 caused by energization and rotation may be accelerated or FPOT may be delayed. Incidentally, FPOT (First Print Out Time) refers to a time it takes from when a printing command is input to the image forming apparatus 10 to when the first recording material with an image formed is discharged from the image forming apparatus 10. Particularly, the effect is likely to be great in the case that the image forming apparatus 10 is used repeatedly for printing jobs with a relatively small number of prints. Thus, it is desirable to minimize a frequency of execution of ATVC control.

Therefore, in Embodiment 1, in the case that a coverage ratio of the image at the leading end portion of the first sheet of the recording material P is lower than a predetermined threshold based on image information of an image which is secondarily transferred to the recording material P, ATVC control is not executed. Because, in this case, it can be estimated that the secondary transfer voltage for the leading end portion of the first sheet of the recording material P has a relatively large tolerance for a deviation range from a value at which optimum transfer property is obtained. Further details will be described below.

As described above, in ATVC control, the target voltage value of the secondary transfer voltage for the leading end portion of the first sheet of the recording material P is selected from predetermined values in order to obtain optimum transfer property depending on the environmental information, the recording material information, the printing mode information, and the like information. This is to determine an optimum target voltage value for each condition so that optimum transfer property can be obtained under various conditions. Viewing from the other side, not executing ATVC control means that the target voltage value of the secondary transfer voltage for the leading end portion of the first sheet of the recording material P may deviate from the optimum value. For example, in the case where the target voltage value is changed from the optimum value to a lower value, there is a possibility that in a solid image, image defect such as a lowering in density with a lowering in transfer efficiency occurs. On the other hand, in the case where the target voltage value is changed from the optimum voltage value to a higher voltage value, there is a possibility that image defect due to electric discharge occurs in a half tone image and the like image by an electric discharge phenomenon due to an excessive potential difference.

However, in the case where the image secondary transferred onto the recording material P is not a solid image or a half tone image but is an image with a low coverage ratio, it has been known that the image defect as described above is not readily visualized. Here, a "coverage ratio" refers to a ratio occupied by an image region (image portion, portion on which toner is placed) per unit area. As regards the image information, discrimination is made depending on whether or not the image exists irrespective of a color of the image, and a region where the image exists is referred to as an image region. In Embodiment 1, the above described predetermined area (unit block) is a region of 24 pixels (main scan direction)×24 pixels (sub scan direction). Incidentally, the main scan direction (the main scan direction of the exposure device 7) is a direction substantially parallel to a rotational axis of the photosensitive drum 2 and corresponds to a direction substantially perpendicular to feeding directions of the intermediary transfer belt 20 and the recording material P. Further, the sub scan direction is a direction substantially perpendicular to the main scan direction and corresponds to a direction substantially parallel to the feeding directions of the intermediary transfer belt 20 and the recording material P. As an example, in the case where the image region is 288 pixels of 24 pixels×24 pixels (total pixel number=576), the coverage ratio is 50%.

For example, in the case where the transfer voltage value is changed from the optimum voltage value to a lower voltage value, as regards the image with the low coverage ratio, a toner amount of the toner to be transferred, that is, a total charge amount of the toner to be transferred is smaller than the amount for the solid image, and therefore, transfer efficiency does not readily lower, so that a transfer property is maintained. On the other hand, also, in the case where the transfer voltage value is changed from the optimum voltage value to a higher voltage value, as regards the image with the low coverage ratio, a toner amount of the toner disturbed by the electric discharge is small, and therefore, the image is not readily visualized as the image defect.

Thus, as regards the image with the low coverage ratio, compared with the solid image and the half tone image, a risk of an occurrence of the image defect with the fluctuation in the transfer voltage becomes small. By suppressing a fluctuation amount of the transfer voltage at a range in which the image defect does not occur in the image with the low coverage ratio, it becomes possible to prevent the image defect from occurring even when the target voltage value of the transfer voltage is not optimized by ATVC control.

For the reasons described above, in Embodiment 1, on the basis of the image information of the image to be transferred onto the leading end position of the first sheet of the recording material P, the "determination of ATVC control execution" is performed.

<Method of Determination of ATVC Control Execution>

Next, a method of the "determination of ATVC control execution" in Embodiment 1 will be described.

As shown in FIG. 2, an image processor 303 includes an image analyzer 401 as an image analyzing means, an image converter 402, and a half toning processor 403. The image analyzer 401 performs the "determination of ATVC control execution" by analyzing the image. The image converter 402 performs image conversion of a character code, and the half toning processor 403 performs half toning processing of a gray scale image, so that bit mapping of the image is carried out.

In Embodiment 1, processing by the image converter 402 is performed in resolution of 600 dpi. Further, in Embodiment 1, the calculation processing by the image analyzer 401 is performed with respect to image data after the processing by the image converter 402 is ended and before the processing by the half toning processor 403 is performed. However, the order of image processing is not limited thereto, but can be appropriately selected.

<Processing Method of Determination of ATVC Control Execution>

Next, a processing method of the "determination of ATVC control execution" by the image analyzer 401 will be described.

Figure 4:
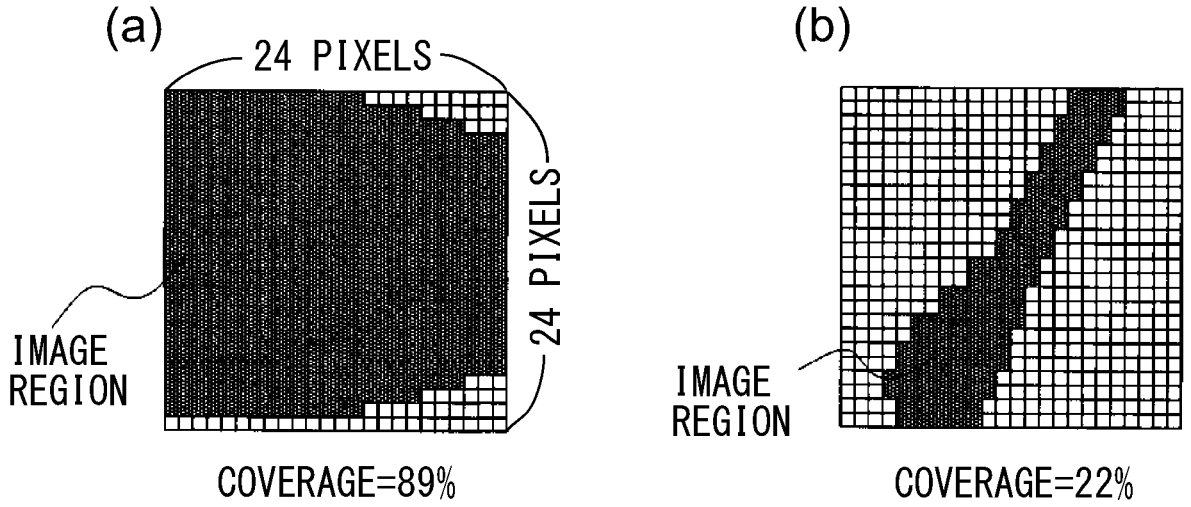
FIG. 4, part (a) and part (b), is a schematic view illustrating a coverage ratio in a unit block.

First, the image analyzer 401 divides an original image (600 dpi) into unit blocks of 24 pixels×24 pixels (total pixel number=576). Next, the image analyzer 401 calculates a coverage ratio in each of all the unit blocks and then discriminates whether or not the coverage ratio in each unit block is smaller than a predetermined threshold. In the case where a ratio occupied by the image region in the unit block is the threshold or more, the image analyzer 401 discriminates that the unit block is a non-low coverage ratio block. On the other hand, in the case where the ratio occupied by the image region in the unit block is less than the threshold, the image analyzer 401 discriminates that the unit block is a low coverage ratio block. In Embodiment 1, the threshold of the coverage ratio is set at 30%. Parts (a) and (b) of FIG. 4 show examples of the ratio occupied by the image region in the unit block. As shown in part (a) of FIG. 4, in the case where the ratio occupied by the image region in the unit block is 30% or more, the image analyzer 401 discriminates that the unit block is the non-low coverage ratio block. On the other hand, as shown in part (b) of FIG. 4, in the case where the ratio occupied by the image region in the unit block is less than 30%, the image analyzer 401 discriminates that the unit block is the low coverage ratio block.

Figure 5:
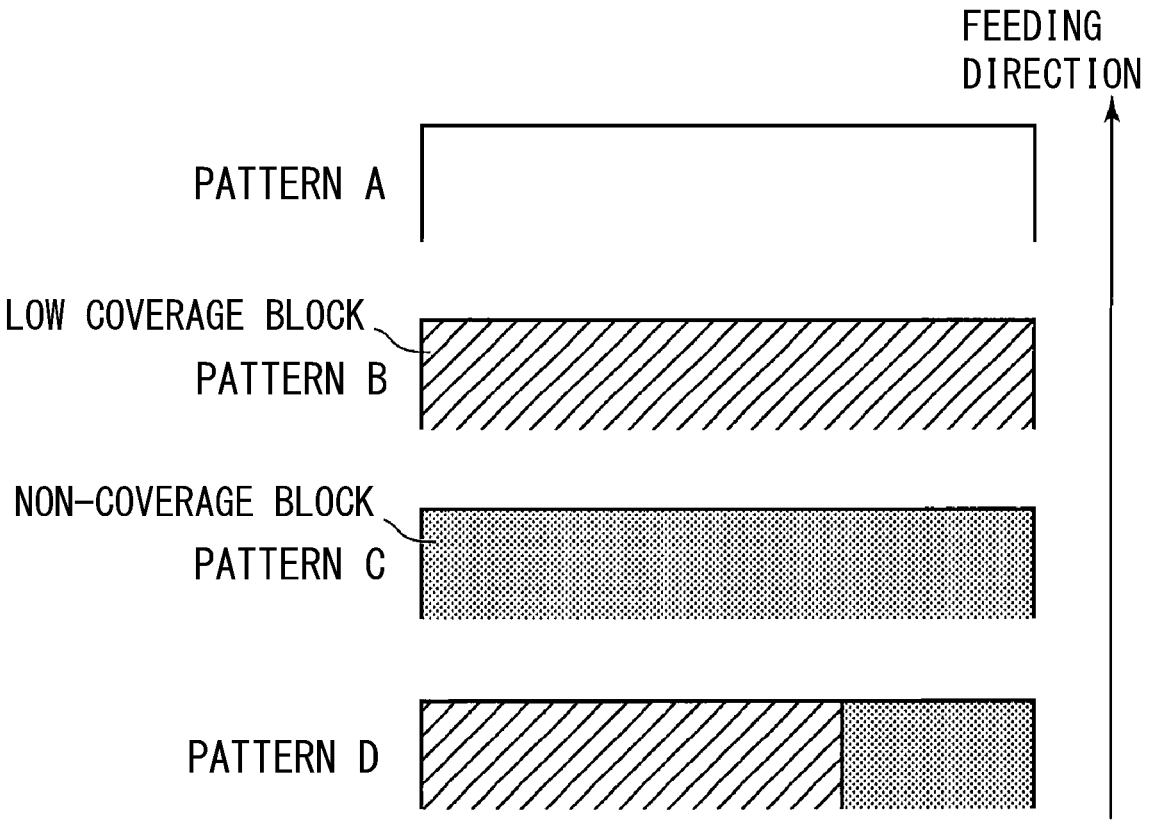
FIG. 5 is a schematic view showing examples of image patterns at a leading end portion of a recording material P.

Next, the image analyzing portion 401 performs the determination of ATVC control execution on the basis of a calculation result of the coverage ratio of each unit block. FIG. 5 shows examples of patterns of images to be secondary transferred to the leading end portion of the first sheet of the recording material P in the secondary transfer portion T2 in patterns A through D.

In Embodiment 1, the image analyzing portion 401 determines not to execute ATVC control, in the case where all the unit blocks are low coverage ratio blocks or marginal portions along the main scan direction in the image of the leading end portion of the first sheet of the recording material P. Here, the "marginal portion" includes a non-image formation region which is a region other than an image formation region where the toner image is capable of being transferred onto the recording material P, a solid white portion in the image formation region on the recording material P, and a region with a dot pattern with a low coverage ratio, such as a solid white portion with electronic watermark (woven pattern watermark) in the image formation region on the recording material P. That is, the "marginal portion" includes a portion where there is image information but the coverage ratio is less than the threshold (that is, a portion where there is no image and the coverage ratio is 0%), and a portion where there is no image information. The region where all the unit blocks are low coverage ratio blocks or marginal portions along the main scan direction described above is also referred to as a "low coverage ratio region" since in either case, the region is a region where a ratio occupied by an image region per unit area is less than the threshold. That is, in Embodiment 1, the image analyzer 401 determines not to execute ATVC control, in the case where the leading end portion of the first sheet of the recording material P is the low coverage ratio region.

Pattern A is a margin portion with no image, and even when the target voltage value of the secondary transfer voltage is not optimized, image defect does not occur, so it is not necessary to execute ATVC control.

For pattern B, all the unit blocks along the main scan direction are the low coverage ratio blocks, so it is not necessary to execute ATVC control.

For pattern C, all the unit blocks along the main scanning direction are the non-low coverage ratio blocks, and when the target voltage value of the secondary transfer voltage is not optimized, image defect may occur, so it is necessary to execute ATVC control.

Pattern D is a mixture of the non-low coverage ratio blocks and low coverage ratio blocks along the main scanning direction. For pattern D, when the target voltage value of the secondary transfer voltage is not optimized, there is no problem in the region of the low coverage ratio block, but image defect may occur in the region of the non-low coverage ratio block, so it is necessary to execute ATVC control.

As described above, in Embodiment 1, the determination of ATVC control execution is performed depending on the image information of the image of the leading end portion of the first sheet of the recording material P.

<Control Method of Determination of ATVC Control Execution>

Figure 6:
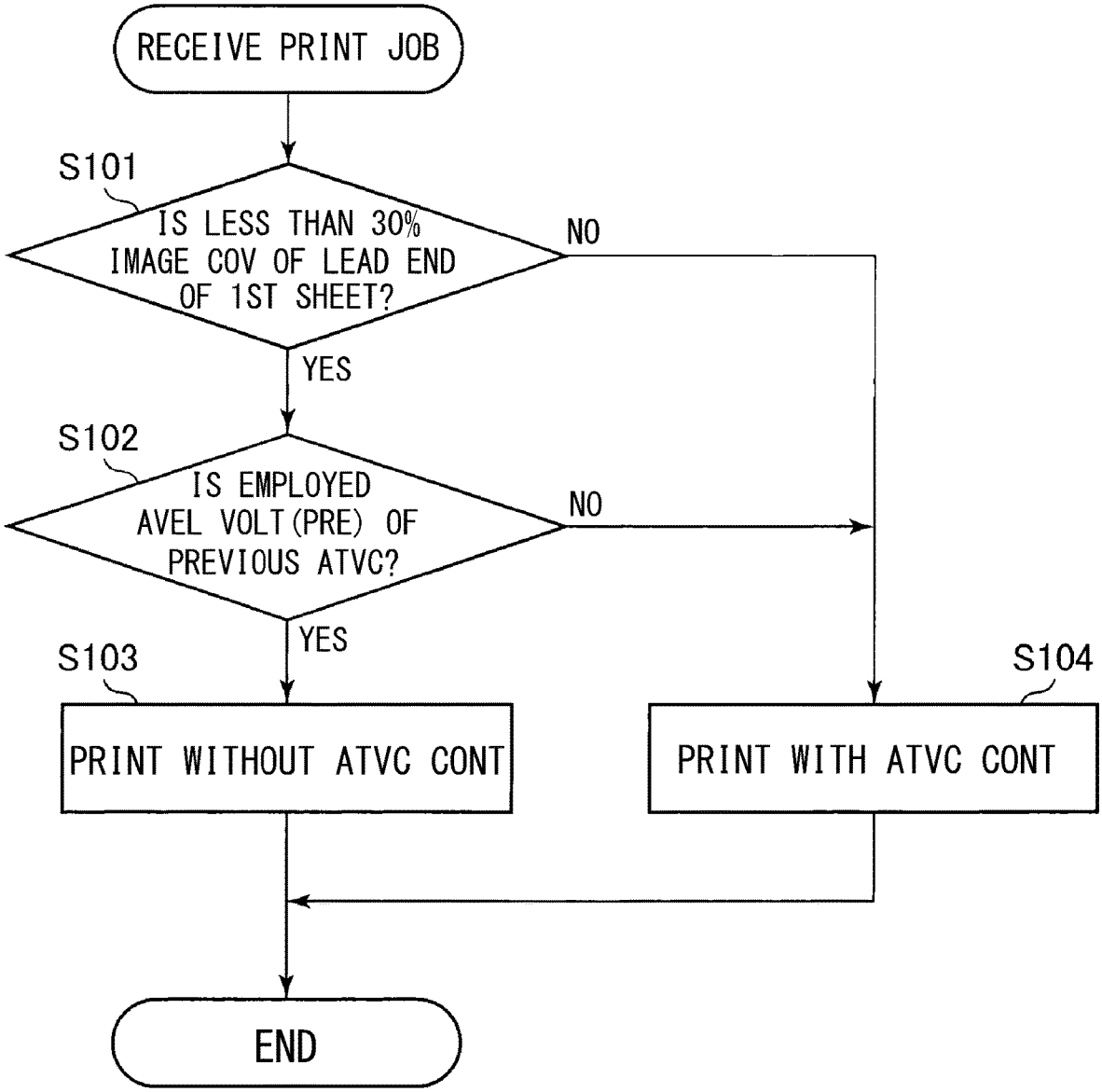
FIG. 6 is a flowchart of a control of Embodiment 1.

Next, the control method of the determination of ATVC control execution in Embodiment 1 will be described. FIG. 6 is a flowchart showing an outline of the control procedure.

First, when the printer control device 304 receives the information of the printing job in the controller 301, it determines in the image analyzer 401 whether or not the coverage ratio of the image of the leading end portion of the first sheet of the recording material P is less than 30% (S101). Incidentally, for the sake of simplicity, an overlapping description of the details of the method for determining the coverage ratio is omitted, but in more detail, whether or not to execute ATVC control is determined as described above with reference to FIG. 5. In the case of "No" in S101, the printer control device 304 controls to execute ATVC control normally and carry out printing (S104) in the CPU 311. On the other hand, in the case of "Yes" in S101, the printer control device 304 determines whether or not the average voltage value (pre) obtained when the previous ATVC control was executed can be employed (S102), in the CPU 311. Incidentally, the average voltage value (pre) is updated and stored in a non-volatile memory (not shown) provided in the engine controller 302 each time ATVC control is executed.

Here, the impedance of the secondary transfer portion T2 during pre-rotation when the recording material P does not exist in the secondary transfer portion T2 varies depending on an installation environment and a usage history (accumulated usage) of the image forming apparatus 10 and the like. It is possible to determine depending on a degree of difference between the impedance of the secondary transfer portion T2 when the previous ATVC control was executed and the current impedance of the secondary transfer portion T2, whether or not the average voltage value (pre) obtained when the previous ATVC control was executed can be employed this time again. In the case where a deviation of the latter from the former is sufficiently small, the average voltage value (pre) obtained when the previous ATVC control was executed can be employed this time again. In Embodiment 1, in the case where an absolute moisture content of the installment environment of the image forming apparatus 10 fluctuates by a predetermined threshold (3.0 [g/m$^3$] in Embodiment 1) or more between the time of the previous ATVC control execution and the current time, or in the case where a number of sheets of printing (which may be the number of sheets of printing which is converted to a predetermined size) since the previous ATVC control execution exceeds the predetermined threshold (5,000 sheets in Embodiment 1), it is determined that ATVC control execution this time is to be carried out. That is, in Embodiment 1, in the case where a fluctuation of the absolute moisture content of the installation environment of the image forming apparatus 10 between the time of the previous ATVC control execution and the current time is less than a predetermined threshold (3.0 [g/m$^3$] in Embodiment 1) and the number of prints since the previous ATVC control execution is less than a predetermined threshold (5,000 in Embodiment 1), the average voltage value (pre) obtained when the previous ATVC control was executed is employed this time again and it is determined that ATVC control execution is not carried out this time. Incidentally, the absolute moisture content can be determined by the CPU 311 depending on detection results of temperature and humidity by an environmental sensor (not shown).

In the case of "No" in S102, the printer control device 304 controls to execute ATVC control normally and carry out printing (S104) in the CPU 311. On the other hand, in the case of "Yes" in S102, the printer control device 204 controls to carry out printing without executing ATVC control (S103) in the CPU 311.

Figure 7:
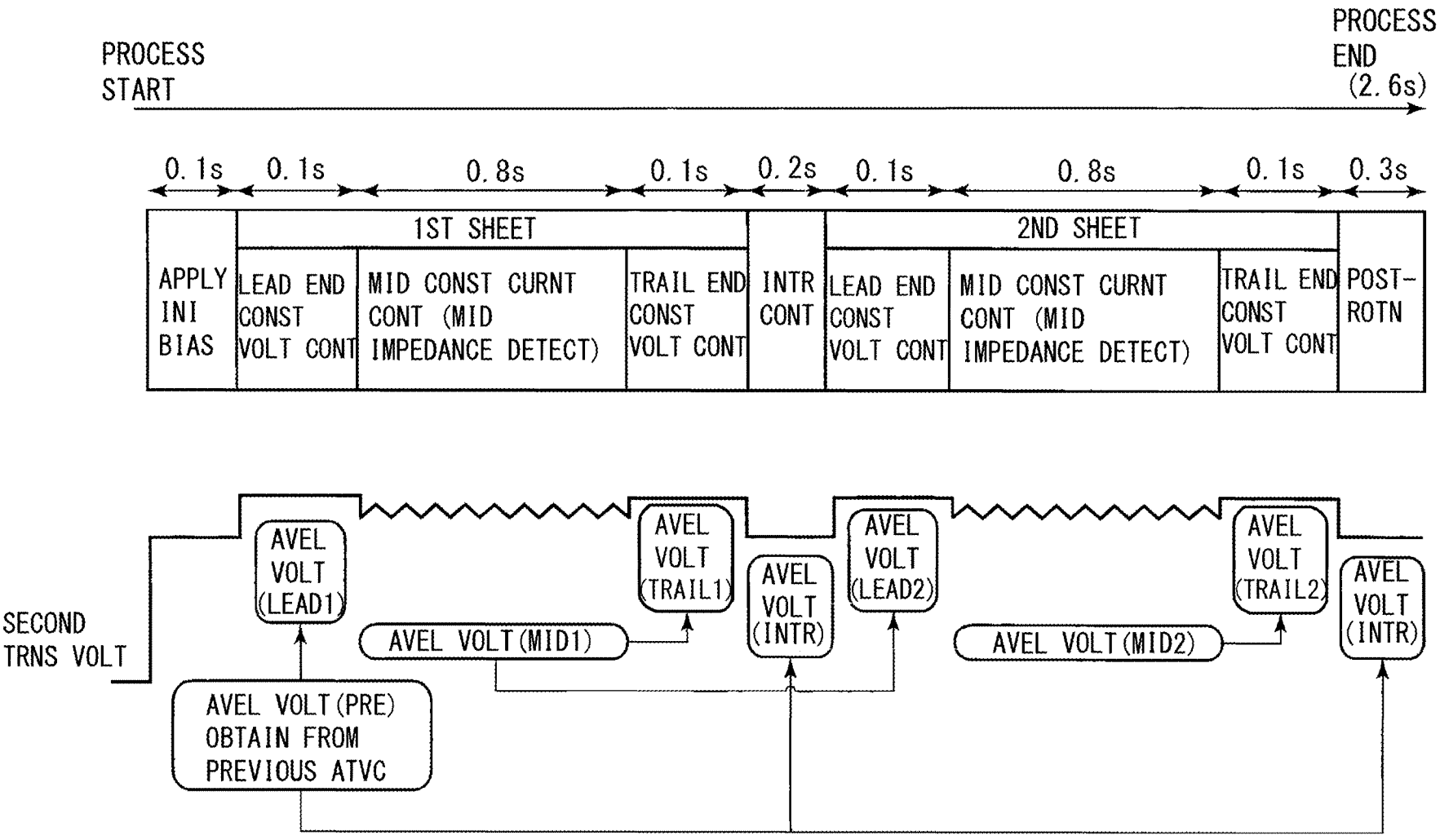
FIG. 7 is a chart showing a timeline of a secondary transfer voltage in a case of printing on two sheets of A4 paper without ATVC control.

With reference to FIG. 7, the timeline of the secondary transfer voltage in the case of carrying out printing without ATVC control in the image forming apparatus 10 in Embodiment 1 will be described. FIG. 7 is a chart showing the timeline of the secondary transfer voltage in the case of carrying out printing on two sheets of A4 paper (210 mm horizontal feeding) as the recording material P without ATVC control. Differences between a case with ATVC control shown in FIG. 3 and a case without ATVC control shown in FIG. 7 are as follows. In the case without ATVC control shown in FIG. 7, the target voltage values, in the leading end portion of the first sheet of the recording material P, during sheet interval, and during post-rotation are determined depending on the average voltage value (pre) obtained in the previous ATVC control. As a result, in the case without ATVC control shown in FIG. 7, time is shortened by 0.3 s for not carrying out pre-rotation impedance detecting compared to the case with ATVC control shown in FIG. 3. In the case with ATVC control shown in FIG. 3, it takes 2.9 s from a process start to a process end, and voltage is applied to the secondary transfer roller 24 over this time. In contrast, in the case without ATVC control shown in FIG. 7, time from the process start to the process end is shortened to 2.6 s, and time for applying voltage to the secondary transfer roller 24 is shortened by 0.3 s. As a result, deterioration of members such as the secondary transfer roller 24 and the intermediary transfer belt 20 due to energization and rotation can be suppressed. Further, FPOT can be shortened by not having ATVC control.

(5) Image Output Experiment Result

Next, a result of an image output experiment, between a comparison example and Embodiment 1, conducted for verifying an effect of Embodiment 1 will be described. Constitutions and operations of the image forming apparatus 10 of the comparison example are substantially the same as those of the image forming apparatus 10 of Embodiment 1, except that ATVC control is executed each time a printing job is carried out.

The image output experiment is conducted by a sheet passing durability test as will be described below, so that an increase of electric resistance of the secondary transfer roller 24 was compared between the comparison example and Embodiment 1. A test environment was 23° C. in temperature and 50% RH in relative humidity. As the recording material P, paper "GFC-081" (Canon Marketing Japan Inc., trade name) was used. And, the printing mode was set to the full color normal printing mode, the printing job which printed one sheet was repeated, and printing of 10,000 sheets was carried out. Incidentally, the full color normal print mode is an example of a full color mode which is selected in the case where plain paper is used as the recording material P.

As an output image, on the leading end portion of the recording material P, an image which has a print ratio (image ratio) of 2% for each of images of yellow, magenta, cyan and black and which has a coverage ratio of 8% in unit block, was used. That is, in the comparison example, ATVC control is executed for every printing job, so ATVC control is executed 10,000 times throughout the durability test. On the other hand, in Embodiment 1, ATVC control is executed only three times, that is, once at a start of the durability test and twice at every 5,000 sheets.

Table 1 shows results of the durability test. The electric resistance of the secondary transfer roller 24 was measured under an environment of 23° C. in temperature, 50% RH in relative humidity by pressing the secondary transfer roller 24 on an aluminum cylinder with a force of 9.8 N, rotating at a peripheral speed of 50 mm/sec, and applying a voltage of 1000 V. Here, when the electric resistance of the secondary transfer roller 24 increases excessively, a desired secondary transfer voltage may not be able to be applied due to exceeding an upper limit of a capacity of the secondary transfer voltage source 44 (voltage output upper limit). Thus, an increase in the electric resistance of the secondary transfer roller 24 may be a factor which determines a life of the secondary transfer roller 24. Incidentally, in both the comparative example and Embodiment 1, any transfer defects due to insufficient transfer voltage (transfer current) or any image defects due to discharge caused by excessive transfer voltage (transfer current) did not occur in images on the recording material P, including images in the leading end portion of the recording material P, throughout the durability test.

TABLE 1

| | CE*1 | EMB. 1*2 |
|---|---|---|
| IE*3 | $3.0 \times 10^7\ \Omega$ | $3.0 \times 10^7\ \Omega$ |
| ER*4 | $6.0 \times 10^7\ \Omega$ | $5.6 \times 10^7\ \Omega$ |
| IV*5 | $3.0 \times 10^7\ \Omega$ | $2.6 \times 10^7\ \Omega$ |

*1"CE" is the comparison example.
*2"EMB. 1" is Embodiment 1.
*3"IE" is the initial electric resistance value of the secondary transfer roller 24.
*4"ER" is the electric resistance value after the durability test of the secondary transfer roller 24.
*5"IV" is the increased value of the electric resistance of the secondary transfer roller 24.

As shown in Table 1, the increase of the electric resistance of the secondary transfer roller 24 is suppressed more in Embodiment 1 than in the comparison example. This is because the increase of the electric resistance of the secondary transfer roller 24 due to a conduction deterioration is proportional to a total time of the voltage application.

Incidentally, in Embodiment 1, a coverage ratio threshold indicating a boundary between low coverage ratio blocks and non-low coverage ratio blocks is set to 30%, but the threshold is not limited to this value in Embodiment 1. The threshold can be appropriately adjusted in view of a transfer property and an occurrence degree of image defect. This threshold may also be changed, for example, every constitution and individual of the image forming apparatus 10, and may also be changed depending on the environmental condition, the recording material condition, the printing mode, and the like even in the same image forming apparatus 10.

Further, in Embodiment 1, a size of the unit block is set at 24 pixels×24 pixels (total pixel number=576 (pixels)). However, the size of this unit block is not limited to the value in Embodiment 1. The size of this unit block may be appropriately adjusted in view of a transfer property and an occurrence degree of image defect.

Further, in Embodiment 1, in the case where it was determined that the impedance of the transfer portion may have changed due to environmental changes and the like, ATVC control was executed again. In contrast, in the case where it is determined that the impedance of the transfer portion may have changed due to environmental changes and the like, a rough adjustment, such as pre-rotation impedance detecting of about half a revolution of the secondary transfer roller 24, may be carried out in order to shorten an energization time for the transfer member. This also helps to suppress the deterioration of members such as the secondary transfer roller 24 and the intermediary transfer belt 20 due to energization and rotation, and to shorten FPOT. Incidentally, in ATVC control, after applying constant-current controlled voltages with a plurality of different target current values and finding voltage and current properties by detecting a plurality of voltage values corresponding to each of them, the voltage value corresponding to desired current value may be calculated based on the voltage and current properties. In this case, the number of target current values in the case of the rough adjustment described above may be smaller than in the case of normal ATVC control (fine adjustment) and the control time may be shortened, etc.

That is, in the case where the coverage ratio of the image in the leading end portion of the recording material P to which the secondary transfer voltage is applied at the target voltage value calculated by ATVC control is sufficiently small, ATVC control may be not executed or the energization time in ATVC control may be shortened. As a result, it is possible to suppress deterioration of the transfer member due to energization and rotation, and further it is also possible to shorten FPOT.

Thus, the image forming apparatus 10 of Embodiment 1 includes an image bearing member 20 which bears a toner image, a transfer member 24 which forms a transfer portion T2 which transfers a toner image from the image bearing member 20 to a transferred member P, a voltage application portion 44 which applies a voltage to the transfer member 24, and a controller 304 which is capable of starting a control operation (ATVC control in Embodiment 1) which applies a control voltage to the transfer member 24 before transferring the toner image from the image bearing member 20 to the transferred member P. Then, in Embodiment 1, the controller 304 is capable of determining whether or not to execute a control operation which may be started before transferring the toner image to the transferred member P, on the basis of the coverage ratio indicating a ratio occupied by an image region per predetermined area regarding the toner image transferred to the transferred member P from the image bearing member 20. In Embodiment 1, the transferred member P described above is a recording material P onto which the toner image is transferred from the image bearing member 20, and the controller 304 makes the determination described above with respect to the control operation which may be started before transferring the toner image to the recording material P based on the coverage ratio, based on the coverage ratio for the toner image to be transferred to a predetermined range on the leading end side with respect to a feeding direction of the recording material P. In Embodiment 1, the controller 304 determines whether to execute the control operation or not, such that the control operation is executed when the coverage ratio is the first value, and the control operation is not executed when the coverage ratio is the second value which is smaller than the first value. However, the controller 304 may determine a time to apply the control voltage as an operational setting of the control operation. In this case, the controller 304 can determine the time to apply the control voltage so that the time to apply the control voltage is shorter for the second value of the coverage ratio, which is smaller than the first value of the coverage ratio, than the case that the coverage ratio is the first value. Further, in Embodiment 1, the controller 304 sets a target value of the transfer voltage to apply to the transfer member 24 when the toner image is transferred to the transferred member P depending on the control operation described above to be executed in the case that the coverage ratio is the first value described above.

In other words, the image forming apparatus 10 of Embodiment 1 includes the controller 304 which is capable of executing a control operation (ATVC control) to set the target value of the transfer voltage to apply to the transfer member 24 when at least a part of the recording material P, which includes a predetermined region on the leading end side of the first sheet of the recording material P with respect to a feeding direction, is passing through the transfer portion T2, by applying the control voltage to the transfer member 24 before the first sheet of the recording material P reaches the transfer portion T2, in the case that the image forming apparatus 10 of Embodiment 1 executes a printing job in which an image is formed on a single or a plurality of recording materials P by a single start instruction. Here, in Embodiment 1, the transfer voltage is controlled by the constant-voltage control in the leading end portion and the trailing end portion of the recording material P, and the transfer voltage is controlled by the constant-current control in a center portion of the recording material P; however, for example, the transfer voltage may be controlled by a constant-voltage control over an entire region of the recording material P. Then, in Embodiment 1, the controller 304 is capable of determining whether or not to execute the control operation before the first sheet of the recording material P reaches the transfer portion T2, on the basis of the coverage ratio indicating a ratio occupied by an image region per predetermined area with respect to the toner image to be transferred to the predetermined region described above of the first sheet of recording material P, in the case of executing the printing job. In Embodiment 1, the controller 304 determines whether to execute the control operation or not, so that the control operation is executed in the case where the coverage ratio is the first value and that the control operation is not executed in the case where the coverage ratio is the second value, which is smaller than the first value. Further, in Embodiment 1, in the case where the controller 304 determines not to execute the control operation, the controller 304 sets the target value of the transfer voltage to apply the transfer member 24 when at least a part of the recording material P, which includes a predetermined region on the first sheet of the recording material P of a current printing job, is passing through the transfer portion 24, depending on the control operation before a previous printing job. Here, in Embodiment 1, a result of the control operation in the previous printing job is used however, results of the control operations before the previous printing job may be appropriately used, depending on a desired control accuracy and the like factors. Further, in the cases where any results of the control operations before the previous printing job are not available, the control operation may be executed in the current printing job. These cases where any results of the control operation before the previous print job are not available include the cases where there are opening and closing of a recording material accommodating portion (cassette) and a door for maintenance of the apparatus, the case where the results do not exist and the like cases, other than the cases where there are environmental changes (changes in absolute moisture content and the likes like) and durability changes (use of a predetermined amount of member, passage of a predetermined amount of time, and the like) as described above. Further, instead of determining whether or not to execute the control operation as described above, the controller 304 is also capable of determining a time of applying the control voltage in the control operation. In this case, the controller 304 is capable of determining the time of applying the control voltage so that the time of applying the control voltage is shorter for the second value of the coverage ratio, which is smaller than the first value, than for the first value of the coverage ratio. Further, in Embodiment 1, the image bearing member 20 described above is the intermediary transfer member 20 which feeds the toner image transferred from the photosensitive member 2 for transferring to the recording material P as the transferred member P described above. However, the present invention is not limited to such a condition, but may also be applied to, for example, a monochrome image forming apparatus, and the image bearing member 20 described above may also be a photosensitive member 2 which bears the toner image to be transferred to the recording material P as the transferred member P described above.

As described above, in Embodiment 1, in the case where the coverage ratio of the image in the leading end portion of the recording material P to which the secondary transfer voltage is applied at the target voltage value calculated by ATVC control is sufficiently small, it is determined that it is not necessary to execute ATVC control and ATVC control is not executed. Thus, according to Embodiment 1, deterioration of members such as the secondary transfer roller 24 and the intermediary transfer belt 20 due to energization and rotation can be suppressed by reducing a frequency of ATVC control execution. Further, according to Embodiment 1, a delay of FPOT can be suppressed by reducing the frequency of ATVC control execution.

Next, another embodiment of the present invention will be described. Basic constitutions and operations of an image forming apparatus in Embodiment 2 are the same as those of the image forming apparatus in Embodiment 1. Accordingly, in the image forming apparatus in Embodiment 2, elements having the same or corresponding functions and constitutions as those in the image forming apparatus in Embodiment 2 will be represented by the same reference numerals or symbols and will be omitted from redundant detailed description by quoting the description in Embodiment 1.

In Embodiment 2, in the case where the coverage ratio of the image in the region in which the primary transfer voltage is applied at the target voltage value calculated by ATVC control of the primary transfer portion T1 is sufficiently small, a timing of the primary transfer (furthermore, a timing of each image forming process (charging, exposure, and developing)) is advanced.

(1) Control Method of Primary Transfer Voltage

<Normal Printing Operation>

Next, the control method of the primary transfer voltage in Embodiment 2 will be described. In Embodiment 2, a voltage of positive polarity is applied from the primary transfer voltage source 40 to the primary transfer roller 5 for primary transferring the toner image on the photosensitive drum 2 onto the intermediary transfer belt 20.

Figure 8:
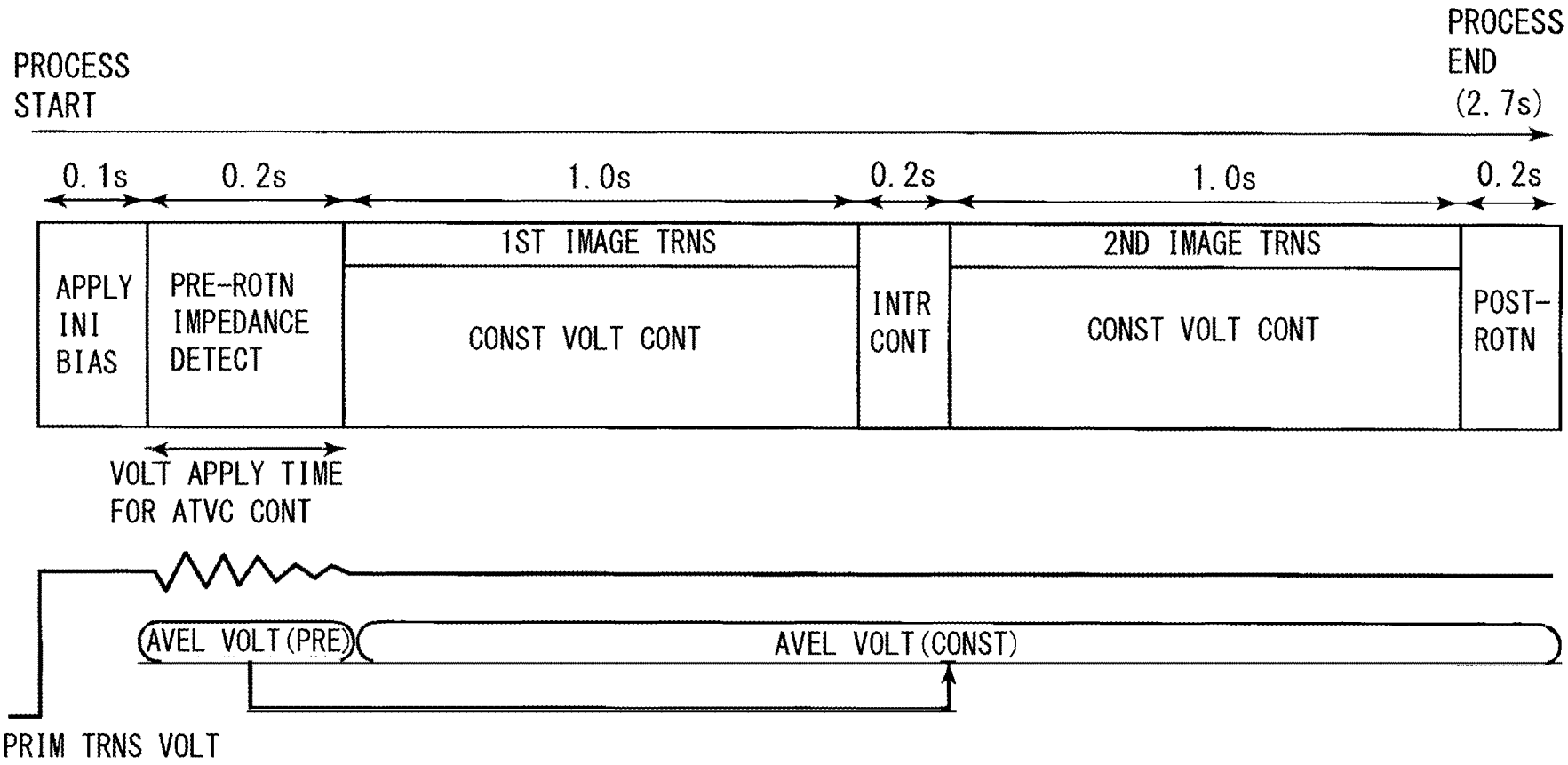
FIG. 8 is a chart showing a timeline of a primary transfer voltage in a case of printing on two sheets of A4 paper with ATVC control.

With reference to FIG. 8, the timeline of the primary transfer voltage in the case of executing ATVC control and carrying out printing normally in the image forming apparatus 10 in Embodiment 2 will be described. As an example, FIG. 8 is a chart showing the timeline of the primary transfer voltage in the case of executing ATVC control and carrying out printing normally on two sheets of A4 paper (210 mm horizontal feeding) as the recording material P in the first image forming portion (image forming portion for yellow) 1*a*. The timeline of the primary transfer voltage in the other image forming portions 1 are similar to this. The control of the primary transfer voltage is performed by the CPU 311.

First, when a process of the printing job starts, the initial bias of the primary transfer voltage is applied to the primary transfer roller 5 from the primary transfer voltage source 40 controlled by constant-voltage control. The initial bias is intended to stabilize the behavior of the voltage, which stabilizes at 0.1 s after startup. The voltage value of this initial bias is selected as a predetermined value so that an optimum transfer property can be obtained according to the environmental information, which is information about the environment (at least one of temperature or humidity). That is, the ROM 312 stores information about the voltage value of the initial bias which is predetermined according to the environmental information and the like information. The CPU 311 can select a corresponding one from the predetermined voltage values of the initial bias stored in the ROM 312 depending on the environmental information, which is obtained from the environmental sensor (not shown), and other information.

Next, pre-rotation impedance detecting is carried out. The purpose of this detecting is to detect the voltage value at which a current of a predetermined target current value is flowing during pre-rotation when there is no toner image in the primary transfer portion T1. That is, the primary transfer voltage source 40 detects the voltage value of the voltage output from the primary transfer voltage source 40 when the test voltage (control voltage) is applied from the primary transfer voltage source 40 to the primary transfer roller 5 with constant-current control so that a current of the predetermined target current value flows during pre-rotation. It is desirable to acquire the detection result for at least one revolution of the primary transfer roller 5, in order to obtain the accurate voltage value. In Embodiment 2, the diameter of the primary transfer roller 5 is 13.4 mm. Thus, a moving distance (distance of voltage application) of the primary transfer roller 5 during applying the test voltage, which corresponds to one revolution of the primary transfer roller 5, is approximately 42 mm. Further, in Embodiment 2, the process speed of the image forming apparatus 10 is 210 mm/s. Thus, the application time of the test voltage (voltage application time) corresponding to one revolution of the primary transfer roller 5 is 0.2 s. Based on the detection result of this voltage value, the CPU 311 calculates the average voltage value (pre), which is the average value of the voltage value at which the current of the predetermined target current value flows. This average voltage value (pre) is also employed as the average voltage value (constant), which is the voltage value of the primary transfer voltage applied from the primary transfer voltage source 40 to the primary transfer roller 5 during the image forming (primary transfer) (further paper interval and post-rotation in Embodiment 2), as shown in the timeline. The target current value described above is selected from predetermined values in order to obtain an optimum transfer property depending on the environmental information and the like information. That is, in the ROM 312, the information on the target current value that is predetermined depending on the environmental information and the like information is stored. The CPU 311 is capable of selecting a corresponding one from the target current value that is predetermined and stored in the ROM 312 depending on the environmental information and the like information obtained in the same way as described above. Incidentally, the average voltage value (constant) can be determined by equaling, multiplying by coefficient times, adding a constant voltage or the like calculation to the average voltage value (pre) (these may be used alone or in combination). In Embodiment 2, the same value as the average voltage value (pre) is the average voltage value (constant), which is the target voltage value of the primary transfer voltage controlled by the constant-voltage control during image forming (primary transferring) (furthermore, during sheet interval and during post-rotation).

What is described above is the timeline of the primary transfer voltage in the case that printing is performed with ATVC control normally.

<Principle of Control in Embodiment 2>

In the same way as described above, as for the primary transfer portion T1, when ATVC control is performed every time the printing job is executed, deterioration of members such as the primary transfer roller 5 and the intermediary transfer belt 20 caused by energization and rotation may be accelerated or FPOT may be delayed. Particularly, the effect is likely to be great in the case that the image forming apparatus 10 is used repeatedly for printing jobs with a relatively small number of prints.

Thus, in Embodiment 2, depending on the image information of the image to be primary transferred to the intermediary transfer belt 20, in the case where the coverage ratio of the image of the leading end portion of the image forming region in the feeding direction on the intermediary transfer belt 20 with respect to the image to be transferred to the first sheet of the recording material P (hereinafter simply referred to as "the leading end portion of the image") is lower than a predetermined threshold, the start timing of the primary transferring is advanced. Because, in this case, it can be estimated that the primary transfer voltage for the leading end portion of the image with respect to the image to be transferred to the first sheet of the recording material P has a relatively large tolerance for the deviation range from the value at which optimum transfer property is obtained. Further will be described below.

Incidentally, the leading end portion of the image is a predetermined width portion of the image forming region on the intermediary transfer belt 20 from the leading end toward the trailing end side with respect to the feeding direction. The width of the leading end portion of the image with respect to the feeding direction of the image forming region on the intermediary transfer belt 20 may be set appropriately depending on the time required for pre-rotation impedance detecting and the like. Incidentally, the image forming region on the intermediary transfer belt 20 is typically a region which contacts with the recording material P in the secondary transfer portion T2, and is substantially the same size as the recording material P. However, the image forming region on the intermediary transfer belt 20 may be smaller than the size of the recording material P. As described above, in Embodiment 2, 0.2 s is required for pre-rotation impedance detecting of ATVC control. In Embodiment 2, the process speed of the image forming apparatus 10 is 210 mm/s, so the distance of the voltage application is 42 mm. That is, the average voltage value (constant) determined by ATVC control can be applied in the region of the non-low coverage block when pre-rotation impedance detecting of ATVC control is started 0.2 s in time and 42 mm in distance before a timing of primary transferring in the region of the non-low coverage block. Thus, in Embodiment 2, the width of the leading end portion of this image is 42 mm. That is, the width of the low coverage ratio region from the leading end to the trailing end portion of the image in the feeding direction is determined by estimating the coverage ratio of the image at least in the leading end portion of this image (42 mm range from the leading end to the trailing end side). Then, the start timing of the primary transferring is advanced so as to complete ATVC control by a time the non-low coverage ratio region reaches the primary transfer portion T1, and a period for carrying out pre-rotation impedance detecting of ATVC control and a period for carrying out the primary transferring are overlapped.

In the case where the start timing of the primary transferring is advanced and the period for carrying out pre-rotation impedance detecting of ATVC control and the period for carrying out the primary transferring are overlapped, the primary transfer voltage is controlled by constant-current control during the period which overlaps with the detection, and controlled by constant-voltage control during the period which does not overlap with the detection.

<Method of Advancement of Start Timing of Primary Transferring>

Next, a method of advancement of the start timing of primary transferring will be described. Incidentally, in order to shorten FPOT, it is necessary to advance not only the start timing of primary transferring, but also the start timing of each image forming process (charging, exposure, and developing) in synchronism with advancement of the start timing of primary transferring. However, for the sake of simplicity, advancement of the start timing of primary transferring will be described in detail. The start timing of each image forming process (charging, exposure, and developing) may be advanced in synchronism with advancement of the start timing of the primary transferring.

Figure 9:
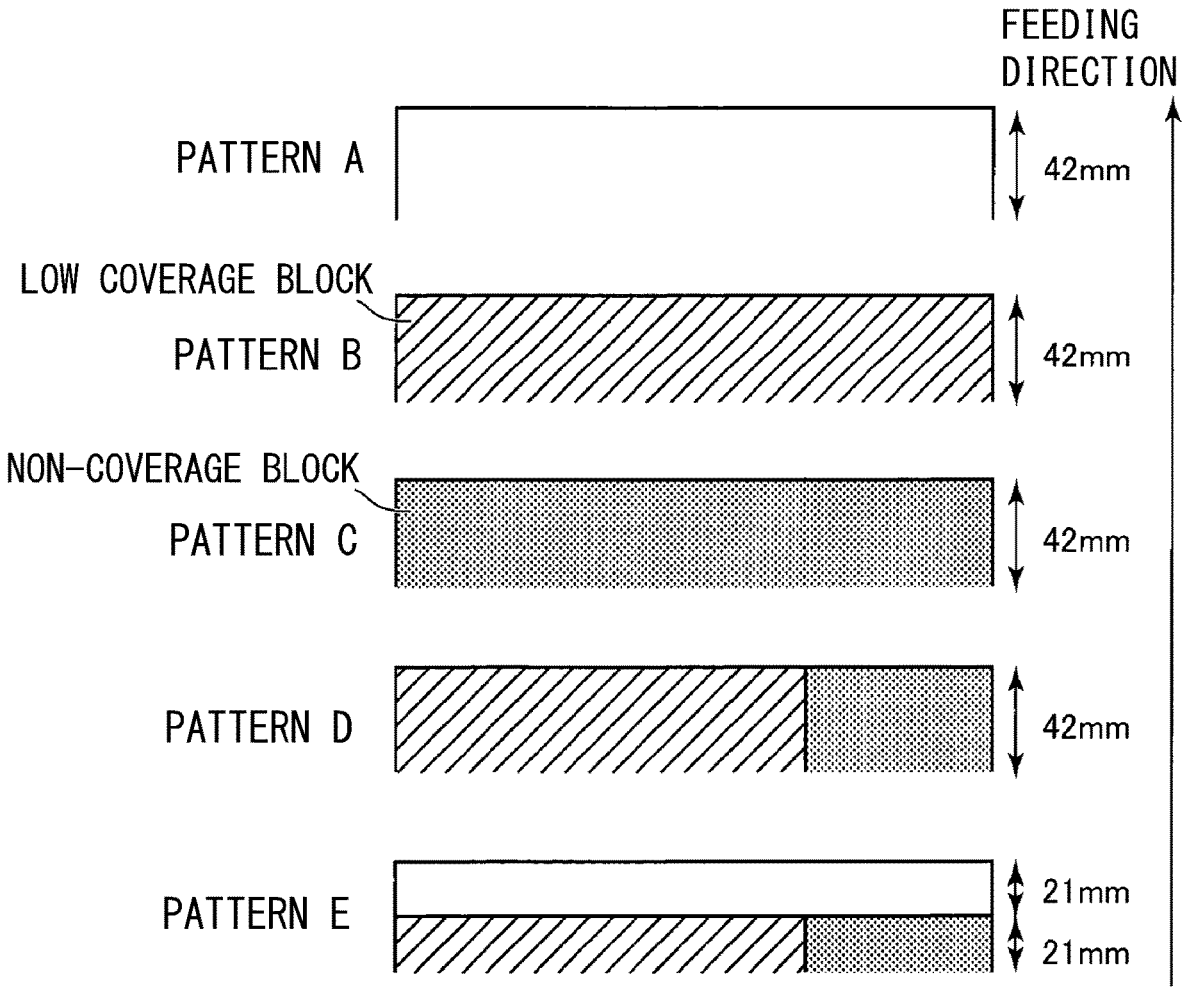
FIG. 9 is a schematic view showing examples of image patterns at a leading end portion of an image.

FIG. 9 shows pattern examples of images in a region (leading end portion of image) of 42 mm from the leading end to the trailing end side with respect to the feeding direction in the image forming region on the intermediary transfer belt 20 regarding the image to be transferred to the first sheet of the recording material P in patterns from A through E.

Incidentally, the method for determining the coverage ratio of images to be primary transferred to the intermediary transfer belt 20 is the same as the method for determining the coverage ratio of images to be secondary transferred to the recording material P as described in Embodiment 1, but it is determined for each image to be primary transferred to the intermediary transfer belt 20 in each primary transfer portion T1. Here, in the full color mode, when the start timing of primary transferring is advanced in one image forming portion 1, the start timing of primary transferring is also advanced in the other image forming portions 1. Thus, the start timing of primary transferring at each primary transfer portion T1 can be advanced in synchronism with the shortest one among times in which the start timing of primary transferring in each primary transfer portion T can be advanced. Further, the information of the coverage ratio of the image which is transferred to the recording material P in the secondary transfer portion T2 may be substituted for the information of the coverage ratio of the image which is transferred to the intermediary transfer belt 20 in each primary transfer portion T1. The image which is secondary transferred to the recording material P in the secondary transfer portion T2 is the image which has been primary transferred to the intermediary transfer belt 20 sequentially in each primary transfer portion T1. Thus, depending on the coverage ratio of the image at the leading end portion of the image which is secondary transferred to the recording material P in the secondary transfer portion T2, the time, corresponding to the shortest one described above and in which the start timing of the primary transfer can be advanced, can be obtained. Further, in the monochrome mode, it is sufficient to obtain the time in which the start timing of primary transferring can be advanced with respect to the image forming portion 1 which forms the image. In this case, in the same way as described above, the information on the coverage ratio of the image which is transferred to the recording material P in the secondary transfer portion T2 may be substituted for the information on the coverage ratio of the image which is transferred to the intermediary transfer belt 20 in the primary transfer portion T1.

Pattern A is the margin portion with no image, and even when the target voltage value of the primary transfer voltage is not optimized, image defect does not occur, so the start timing of primary transferring can be advanced by 0.2 s. That is, the start timing of primary transferring can be advanced so that an entire period for executing pre-rotation impedance detecting overlaps with a period for executing primary transferring. Here, the "marginal portion" includes a region with a dot pattern with a low coverage ratio, such as an electronic watermark (woven pattern watermark) in a solid white portion on the recording material P.

For pattern B, all the unit blocks along the main scan direction are the low coverage ratio blocks, so the start timing of primary transferring can be advanced by 0.2 s. That is, the start timing of primary transferring can be advanced so that the entire period for executing pre-rotation impedance detecting overlaps with the period for executing primary transferring.

For pattern C, all the unit blocks along the main scanning direction are the non-low coverage ratio blocks, and when the target voltage value of the primary transfer voltage is not optimized, image defect may occur, so the start timing of primary transferring is not advanced. That is, printing is carried out normally without advancing the start timing of primary transferring, so that the entire period for executing pre-rotation impedance detecting does not overlap with the period for executing primary transferring.

Pattern D is the mixture of the non-low coverage ratio blocks and low coverage ratio blocks along the main scanning direction. For pattern D, when the target voltage value of the primary transfer voltage is not optimized, there is no problem in the region of the low coverage ratio block, but image defect may occur in the region of the non-low coverage ratio block, so the start timing of primary transferring is not advanced. That is, printing is carried out normally without advancing the start timing of primary transferring, so that the entire period for executing pre-rotation impedance detecting does not overlap with the period for executing primary transferring.

Further, for pattern E, a region from the leading end to 21 mm toward the trailing end side is the margin portion with no image, and a region of the trailing end side from the leading end to 21 mm toward the trailing end side includes the region of the no low coverage ratio block. In this case, the start timing of primary transferring can be advanced by 0.1 s. That is, the start timing of primary transferring can be advanced, so that half of the period for executing pre-rotation impedance detecting overlaps with the period for executing primary transferring.

As described above, in Embodiment 2, "the determination of the advancement of the starting timing of primary transferring" is performed depending on the image information of the leading end portion of the image with respect to the image which is transferred to the first sheet of the recording material P.

<Control Method for Determination to Advance Start Timing of Primary Transferring>

Figure 10:
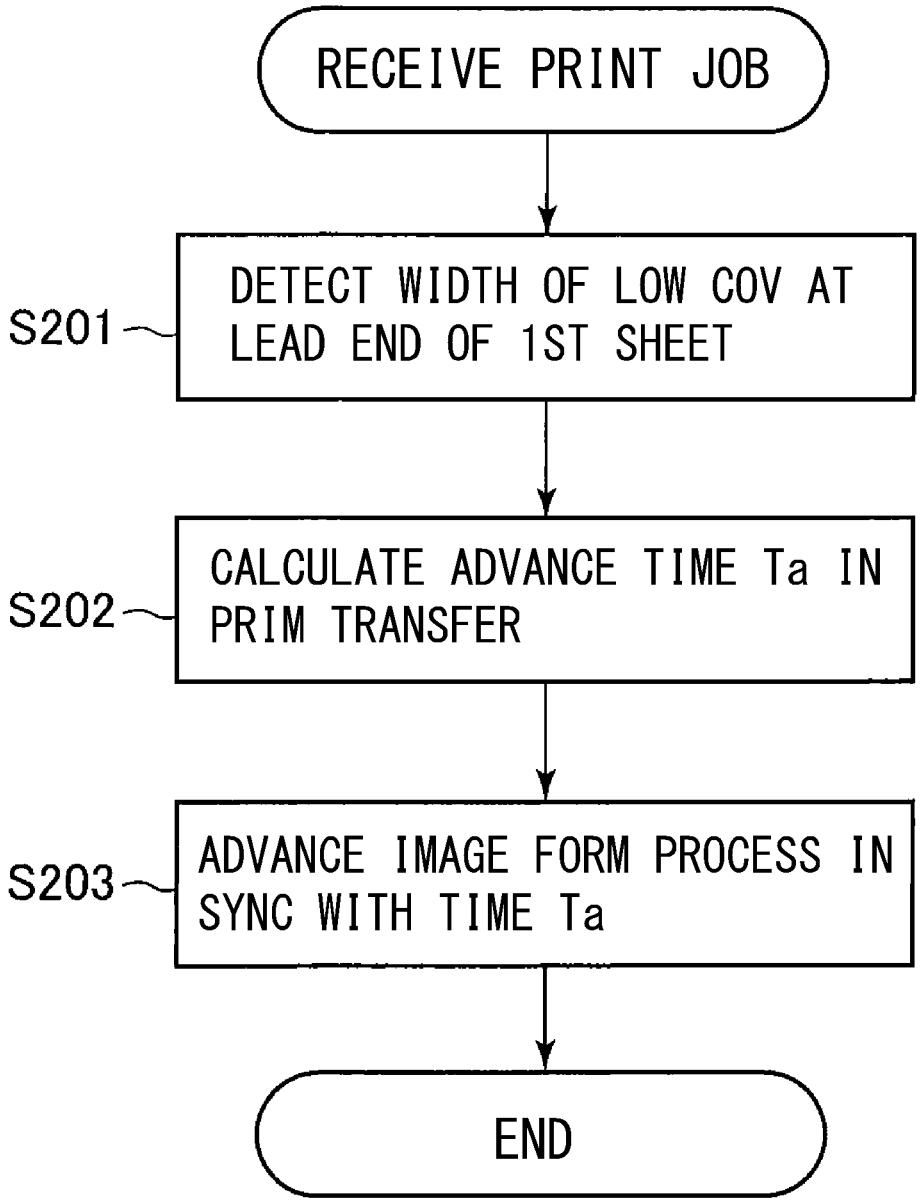
FIG. 10 is a flowchart of a control of Embodiment 2.

Next, the control method for determination to advance the start timing of primary transferring in Embodiment 2 will be described. FIG. 10 is the flowchart showing an outline of the control procedure.

First, when the printer control device 304 receives the information of the printing job in the controller 301, it detects, in the image analyzer 401, the width of the low coverage ratio region with respect to the feeding direction in the leading end portion of the image related to the image which is transferred to the first sheet of the recording material P (S201). Since the method of calculating the image coverage ratio and the like are the same as in Embodiment 1, redundant detailed descriptions will be omitted here. Next, the printer control device 304 calculates, in the CPU 311, a time Ta [s] (including Ta=0 s) which can be advanced for the start timing of primary transferring (S202). That is, it calculates a time (period) in which the period for carrying out pre-rotation impedance detecting and the period for carrying out the primary transferring can be overlapped, so that pre-rotation impedance detecting is completed before the non-low coverage ratio region reaches the primary transfer portion T1. Next, the printer control device 304 controls, in the CPU 311, so as to carry out printing by advancing the timing of each image forming process (charging, exposure, and developing) and the start timing of primary transferring in synchronism with the time Ta [s] which can be advanced (S203). Incidentally, cases of carrying out printing by advancing the timing in synchronism with the time Ta [s] which can be advanced as described above include a case where the timing is not advanced, that is, Ta=0 s.

Figure 11:
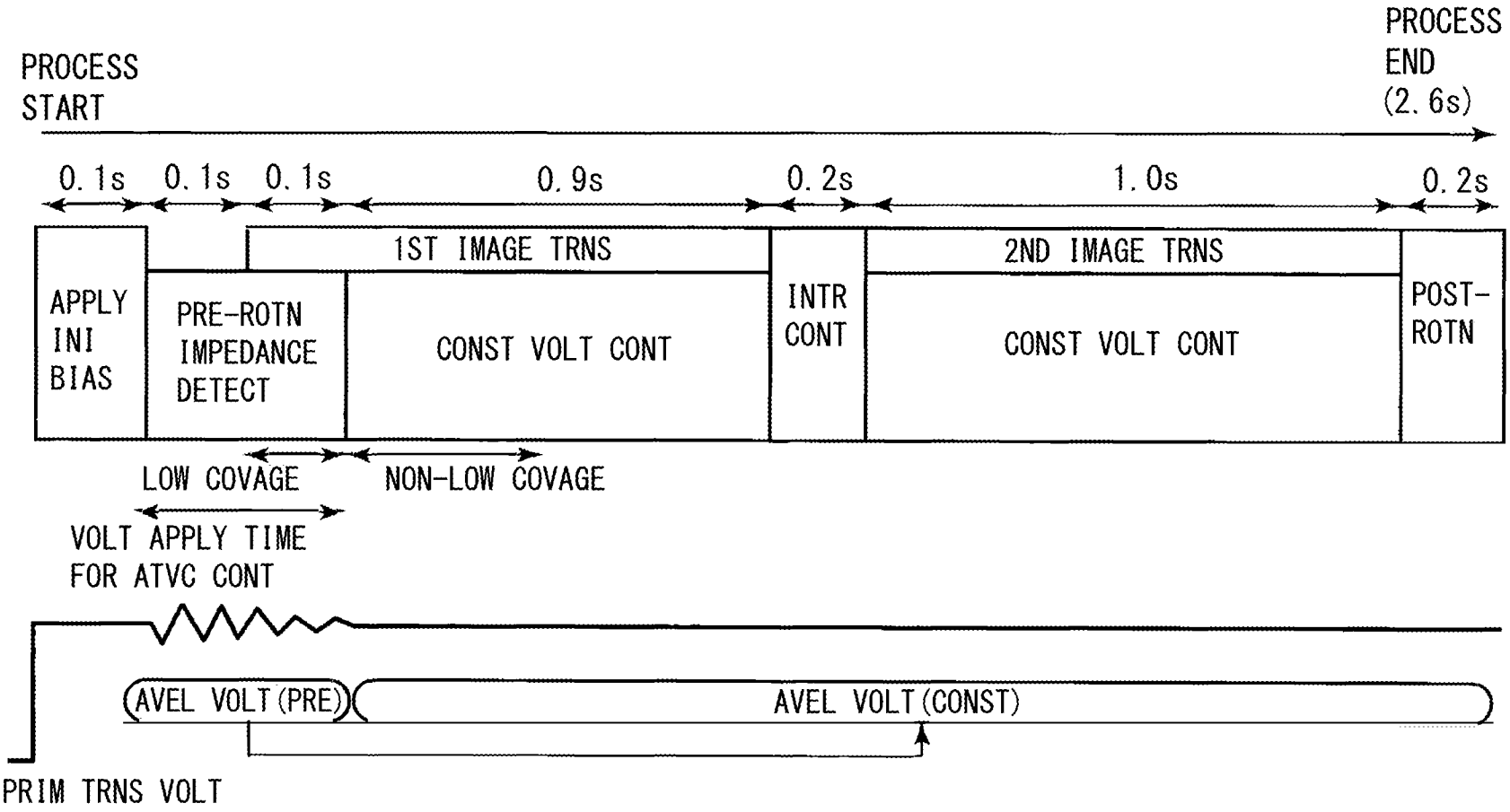
FIG. 11 is a chart showing a timeline of a primary transfer voltage in a case of printing on two sheets of A4 paper while advancing a primary transfer.

With reference to FIG. 11, the timeline of the primary transfer voltage in the case of printing while advancing the start timing of primary transferring in the image forming apparatus 10 of Embodiment 2 will be described. As an example, FIG. 11 is the chart showing the timeline of the primary transfer voltage in the case of advancing the start timing of primary transferring and carrying out printing on two sheets of A4 paper (210 mm horizontal feeding) as the recording material P in the first image forming portion 1*a*. Here, the pattern of the leading end portion of the image related to the image which is transferred to the first sheet of the recording material P is the pattern E shown in FIG. 9. Difference between the case where the start timing of primary transferring is not advanced as shown in FIG. 8 and the case where the start timing of primary transferring is advanced as shown in FIG. 11 is a following point. In the case of advancing the start timing of primary transferring shown in FIG. 11, the start timing of the primary transfer is advanced by the width of the low coverage ratio region of the leading end portion of the image related to the image which is transferred to the first sheet of the recording material P, and the primary transferring is started in a middle of pre-rotation impedance detecting. In the case where the start timing of primary transferring is not advanced as shown in FIG. 8, it takes 2.7 s from the process start to the process end. On the other hand, in the case where the start timing of primary transferring is advanced as shown in FIG. 11, a time from the process start to the process end is reduced to 2.6 s because the start timing of primary transferring is advanced by 0.1 s. As a result, deteriorations of the members such as the primary transfer roller 5 and the intermediary transfer belt 20 due to energization and rotation are suppressed. Further, FPOT can be shortened by the time which the start timing of primary transferring is advanced.

(2) Image Output Experiment Result

Next, a result of an image output experiment, between the comparison example and Embodiment 2, conducted for verifying an effect of Embodiment 2 will be described. Constitutions and operations of the image forming apparatus 10 of the comparison example are substantially the same as those of the image forming apparatus 10 of Embodiment 2, except that a printing job is carried out normally without advancing the start timing of primary transferring.

The image output experiment is conducted by comparing FPOT between the comparison example and Embodiment 2. An experiment environment was 23° C. in temperature and 50% RH in relative humidity. As the recording material P, paper "GFC-081" (Canon Marketing Japan Inc., trade name) was used. And, the printing mode was set to the full color normal printing mode, printing of 1 sheet was carried out and FPOT was measured. As an output image, on the leading end portion of the recording material P, an image which has a print ratio of 2% for each of images of yellow, magenta, cyan and black and which has a coverage ratio of 8% in unit block, was used. That is, in the comparison example, printing was carried out normally, but in Embodiment 2, the start timing of primary transferring and the timing of each image forming process (charging, exposure, and developing) were advanced by 0.2 s. Table 2 shows an experiment result. Incidentally, in both the comparative example and Embodiment 2, any transfer defects due to insufficient transfer voltage (transfer current) or any image defects due to discharge caused by excessive transfer voltage (transfer current) were not occurred did not occur.

TABLE 2

| | CE*1 | EMB*2 |
|---|---|---|
| FPOT | 5.0 s | 4.8 s |

*1"CE" is the comparison example.
*2"EMB" is Embodiment.

As shown in Table 2, Embodiment 2 shortens FPOT more than the comparison example.

Incidentally, in Embodiment 2, the timing of primary transferring and the timing of each image forming process were advanced in the case where the coverage ratio of the leading end position of the image was low, however, a following procedure may be applied in order to further shorten FPOT and the like. For example, in the case where the environmental changes and the like since the previous execution of ATVC control is small and a possibility, that the impedance of the transfer portion is changed, is determined to be small, the rough adjustment which is, for example, pre-rotation impedance detecting of the primary transfer roller 5 for about half a revolution may be carried out.

That is, in the case where the coverage ratio of the image in the region in which the primary transfer voltage is applied at the target voltage value calculated by ATVC control of the primary transfer portion T1 is sufficiently small, it is possible that the start timing of primary transferring is advanced and, furthermore, the energizing time for the transfer member in ATVC control is shortened. As a result, it is possible to suppress deterioration of the transfer member due to energization and rotation, and further it is also possible to shorten FPOT.

Then, in Embodiment 2, on the basis of the coverage ratio indicating a ratio occupied by an image region per predetermined area for the toner image to be transferred to the transferred member 20 from the image bearing member 2, the printer control device 304 is capable of determining the timing of transferring the toner image to the transferred member 20 described above with respect to a period in which the control operation, which may be started before the toner image is transferred to the transferred member 20, is executed. In Embodiment 2, on the basis of the coverage ratio regarding the toner image transferred to a predetermined area of the transferred member 20 on a leading end side with respect to a feeding direction of the image formation region where the toner image is capable of being transferred onto the transferred member 20, the printer control device 304 makes the determination described above with respect to the control operation which may be started before transferring the toner image to the transferred member 20. In Embodiment 2, the printer control device 304 performs so that the period for executing the control operation does not overlap with the period for transferring the toner image to the transferred member 20 in the case where the coverage ratio is the first value, and performs so that the period for executing the control operation overlaps with at least a part of the period for transferring the toner image to the transferred member 20 in the case where the coverage ratio is the second value which is smaller than the first value.

In other words, the image forming apparatus 10 in Embodiment 2 includes the printer control device 304 which is capable of executing the control operation (ATVC control) to set the target value of the transfer voltage to apply the transfer member 5 within at least a part of the period when the toner image is transferred to the transferred member 20 by applying the control voltage to the transfer member 5 before starting transfer of the toner image of the image which is formed on the first sheet of the recording material P from the image bearing member 2 to the transferred member 20, when the printing job for forming the image onto one or a plurality of the recording materials P by one starting instruction is executed. And in Embodiment 2, on the basis of the coverage ratio indicating the ratio occupied by the image region per predetermined area regarding the toner image transferred to the predetermined area of the transferred member 20 on the leading end side with respect to the feeding direction of the image formation region where the toner image of the image formed on the first sheet of the recording material P on the transferred member 20 may be transferred, the printer control device 304 is capable of determining the start timing of transferring the toner image of the image formed on the first sheet of the recording material P from the image bearing member 2 to the transferred member 20. In Embodiment 2, the printer control device 304 determines the timing described above, so that the period for executing the control operation does not overlap with the period for transferring the toner image to the transferred member 20 in the case where the coverage ratio is the first value, and performs so that the period for executing the control operation overlaps with at least a part of the period for transferring the toner image to the transferred member 20 in the case where the coverage ratio is the second value which is smaller than the first value. Further, in Embodiment 2, the transferred member 20 described above is the intermediary transfer member 20 which feeds the toner image transferred from the image bearing member 2 for transferring to the recording material P. However, the present invention is not limited to such a condition, but may also be applied to, for example, a monochrome image forming apparatus, and the transferred member 20 described above may also be the recording material P on which the toner image is transferred from the image bearing member 2.

As described above, in Embodiment 2, in the case where the coverage ratio of the image in the region in which the primary transfer voltage is applied at the target voltage value calculated by ATVC control is sufficiently small, the timing of primary transferring (furthermore, the timing of each image forming process) is advanced. As a result, deteriorations of the members such as the secondary transfer roller 24 and the intermediary transfer belt 20 due to energization and rotation are suppressed, by reducing the energization time and the rotation time only for ATVC control. Further, FPOT can be shortened by advancing the start timing of primary transferring.

Next, another embodiment of the present invention will be described. Basic constitutions and operations of an image forming apparatus in Embodiment 3 are the same as those of the image forming apparatus in Embodiment 1. Accordingly, in the image forming apparatus in Embodiment 3, elements having the same or corresponding functions and constitutions as those in the image forming apparatus in Embodiment 1 will be represented by the same reference numerals or symbols and will be omitted from redundant detailed description by quoting the description in Embodiment 1.

In Embodiment 1, it was described that deterioration of members due to energization and rotation can be suppressed by reducing a frequency of ATVC control execution. In Embodiment 3, instead of omitting ATVC control in Embodiment 1, another control method substituted for ATVC control will be described.

(1) Bleeding Out of Ion Conductive Agent

In Embodiment 3, an electroconductive agent having an ion-conductive property (ion conductive agent) is used as the electroconductive agent for the intermediary transfer belt 20. The intermediary transfer belt whose conductive type is ion-conductive has, for example, the following advantages, compared to intermediary transfer belts with electroconductive properties which are the other major conductive types. That is, it is easy to exhibit a target electric resistance value when the intermediary transfer belt with medium electric resistance is prepared. Further, fluctuations in electric resistance in long term use are small. On the other hand, when an electric current is continuously applied to the ion-conductive intermediary transfer belt in one direction, dissociation and uneven distribution (hereinafter referred to simply as "uneven distribution") of the ion conductive agent in the intermediary transfer belt may occur. Then, this may cause the ion conductive agent to bleed out onto the surface of the intermediary transfer belt and increase the electric resistance of the intermediary transfer belt. When the ion conductive agent bleeds out, problems may occur since the ion conductive agent contaminates other members which contact with the surface of the intermediary transfer belt. For example, when the ion conductive agent is attached to the leading end portion of the cleaning blade, which is provided to clean the toner remaining on the intermediary transfer belt, a cleaning performance of the cleaning blade may deteriorate and cleaning defects may occur.

Further, these problems caused by bleeding out of the ion conductive agent also apply to the secondary transfer roller 24 whose elastic layer contains the ion conductive agent as the conductive agent, and may lead to an increase in the electric resistance of the secondary transfer roller 24.

As a countermeasure against the bleed out phenomenon of the ion conductive agent, it is effective to balance a forward integrated current value which is in the same direction as the current during image forming, and a reverse integrated current value which is in the opposite direction to the current during image forming, by executing an adjustment operation in which a voltage of an opposite polarity to the current at a time of image forming is applied during non-image forming.

Thus, in Embodiment 3, in the case where the coverage ratio of the image in the leading end portion of the recording material P to which the secondary transfer voltage is applied at the target voltage value calculated by ATVC control of the secondary transfer portion T2 is sufficiently small, it is determined that it is not necessary to execute ATVC control and ATVC control is not executed. And, instead, the voltage of the opposite polarity from the time of image forming (secondary transferring) is applied to the secondary transfer roller 24.

(2) Method of Controlling Secondary Transfer Voltage

<Timeline of Secondary Transfer Voltage>

Figure 12:
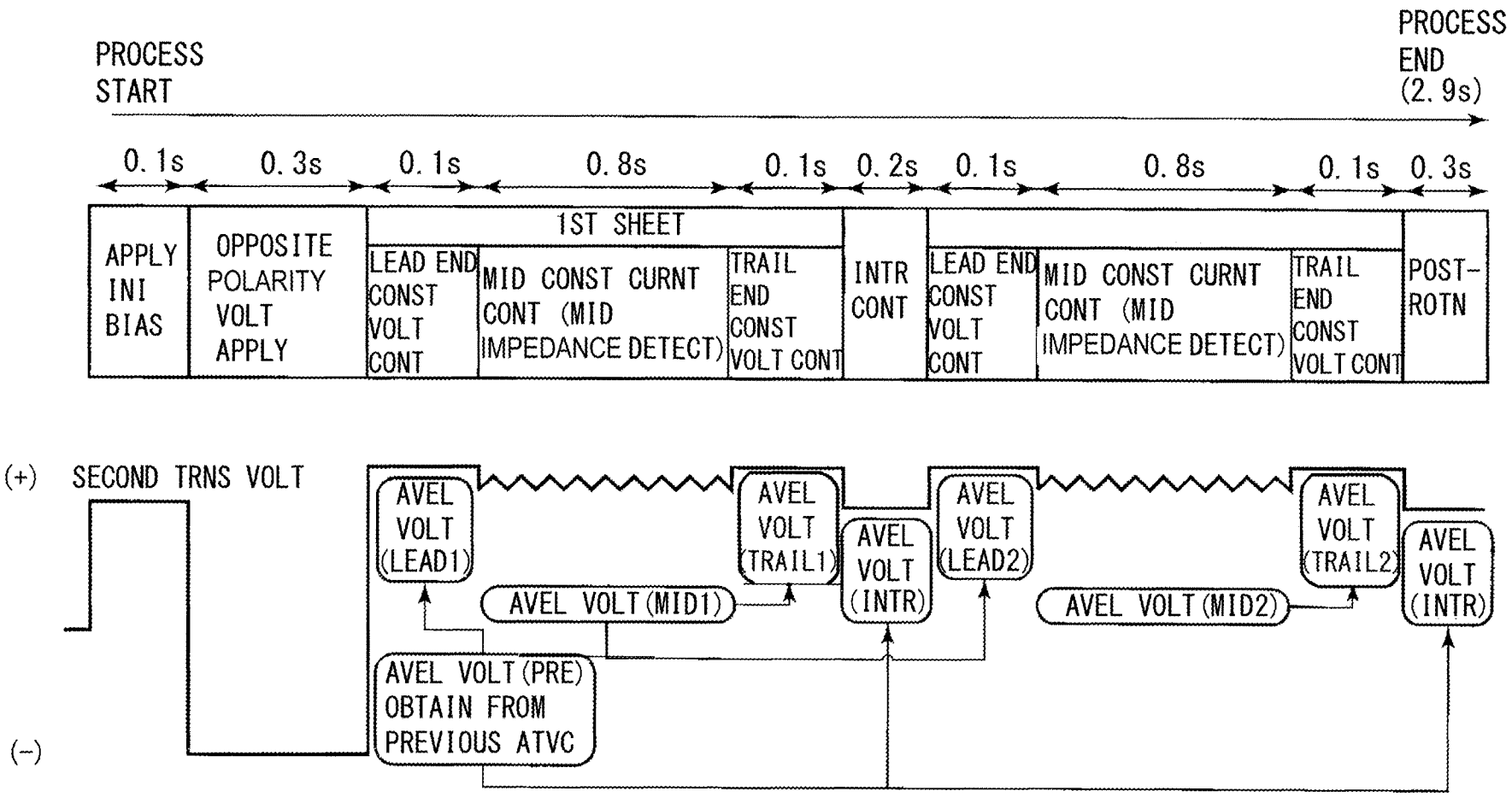
FIG. 12 is a chart showing a timeline of a secondary transfer voltage in a case of printing on two sheets of A4 paper while applying a voltage of an opposite polarity instead of ATVC control.

With reference to FIG. 12, the timeline of the secondary transfer voltage in the case where the voltage of the opposite polarity is applied without ATVC control in the image forming apparatus 10 of Embodiment 3 will be described. FIG. 12 is a chart showing the timeline of the secondary transfer voltage in the case of carrying out printing on two sheets of A4 paper (210 mm horizontal feeding) as the recording material P, while the voltage of the opposite polarity is applied without ATVC control. Differences between the case with ATVC control shown in FIG. 3 as described in Embodiment 1 and the case where the voltage of the opposite polarity is applied without ATVC control shown in FIG. 12 are as follows. In the timeline shown in FIG. 12, the voltage of the opposite polarity from the time of image forming (secondary transferring) is applied to the secondary transfer roller 24 during a time which is corresponding to a time when pre-rotation impedance detecting is performed in ATVC control. The voltage value of this voltage of the opposite polarity is selected as a predetermined value according to the environmental information, which is information about the environment (at least one of temperature or humidity), the printing mode information, and the like information. That is, the ROM 312 stores information about the voltage value of the voltage of the opposite polarity described above which is predetermined according to the environmental information, the printing mode information, and the like information. The CPU 311 can select a corresponding one from the predetermined voltage values of the voltage of the opposite polarity described above stored in the ROM 312 depending on the environmental information, which is obtained from the environmental sensor (not shown), the printing mode information, and other information. Further, in the timeline shown in FIG. 12, the target voltage values, in the leading end portion of the first sheet of the recording material P, during sheet interval, and during post-rotation are determined depending on the average voltage value (pre) obtained in the previous ATVC control.

In Embodiment 1, in the case where it is not necessary to execute ATVC control, pre-rotation impedance detecting was skipped however, in Embodiment 3, the voltage of the opposite polarity applied at the time of image forming (secondary transferring) is applied during a time when pre-rotation impedance detecting was carried out. As a result, bleeding out of the ion conductive agent on the intermediary transfer belt 20 and the secondary transfer roller 24 is further suppressed.

<Control Method for Determination to Execute ATVC Control or to Apply Opposite Polarity Voltage>

Figure 13:
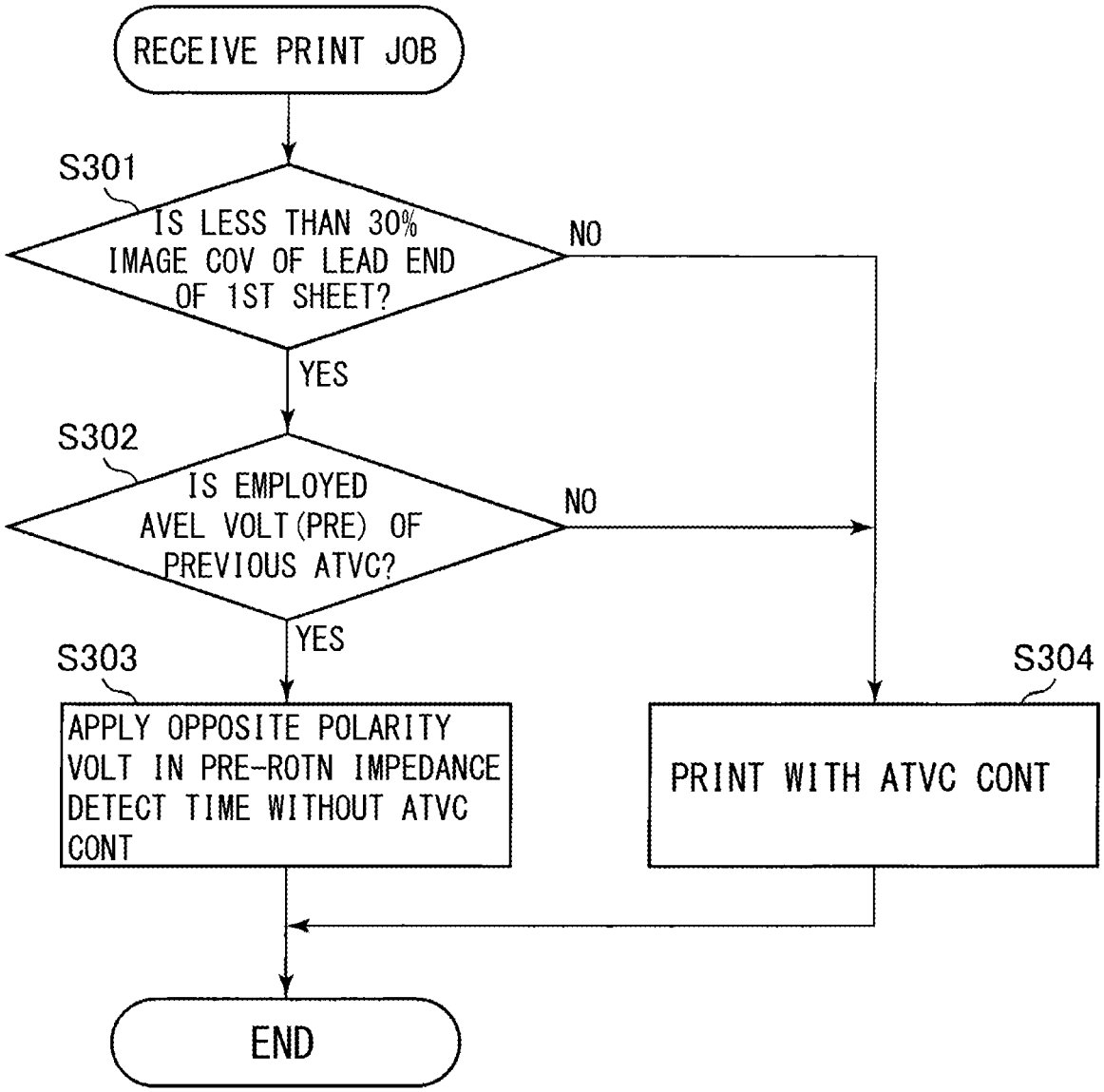
FIG. 13 is a flowchart of a control of Embodiment 3.

Next, the control method for determination to execute ATVC control or to apply opposite polarity voltage in Embodiment 3 will be described. FIG. 13 is a flow chart showing an outline of the control procedure.

First, when the printer control device 304 receives the information of the printing job in the controller 301, it determines in the image analyzer 401 whether or not the coverage ratio of the image of the leading end portion of the first sheet of the recording material P is less than 30% (S301). Incidentally, for the sake of simplicity, the overlapping description of the details of the method for determining the coverage ratio is omitted, but in more detail, whether or not to execute ATVC control is determined in the same way as described in Embodiment 1 with reference to FIG. 5. In the case of "No" in S301, the printer control device 304 controls to execute ATVC control normally and carry out printing (S304) in the CPU 311. On the other hand, in the case of "Yes" in S301, the printer control device 304 determines whether or not the average voltage value (pre) obtained when the previous ATVC control was executed can be employed (S302) in the CPU 311. The method for determination in this time is in the same way as described in Embodiment 1 with reference to FIG. 6. In Embodiment 3, in the case where the absolute moisture content of the installment environment of the image forming apparatus 10 fluctuates by the predetermined threshold (3.0 [g/m$^3$] in Embodiment 3) or more between the time of the previous ATVC control execution and the current time, or in the case where the number of sheets of printing (which may be the number of sheets of printing which is converted to the predetermined size) since the previous ATVC control execution exceeds the predetermined threshold (5,000 sheets in Embodiment 3), it is determined that ATVC control execution this time is to be carried out.

In the case of "No" in S302, the printer control device 304 controls to execute ATVC control normally and carry out printing (S304) in the CPU 311. On the other hand, in the case of "Yes" in S302, the printer control device 304 performs as described below. That is, in the CPU 311, the voltage of the opposite polarity from the time of image forming (secondary transferring) is applied to the secondary transfer roller 24 during the time which is corresponding to the time when pre-rotation impedance detecting is performed in ATVC control (S303).

(3) Image Output Experiment Result

Next, a result of an image output experiment, between the comparison example and Embodiment 3, conducted for verifying an effect of Embodiment 3 will be described. Constitutions and operations of the image forming apparatus 10 of the comparison example are substantially the same as those of the image forming apparatus 10 of Embodiment 3, except that ATVC control is executed each time the printing job is carried out.

The image output experiment is conducted by the sheet passing durability test as will be described below, so that the cleaning performance of the intermediary transfer belt 20 and the increase of electric resistance of the secondary transfer roller 24 were compared between the comparison example and Embodiment 3. A test environment was 23° C. in temperature and 50% RH in relative humidity. As the recording material P, paper "GFC-081" (Canon Marketing Japan Inc., trade name) was used. And, the printing mode was set to the full color normal printing mode, the printing job which printed one sheet was repeated, and printing of 10,000 sheets was carried out.

As an output image, on the leading end portion of the recording material P, an image which has a print ratio of 2% for each of images of yellow, magenta, cyan and black and which has a coverage ratio of 8% in unit block, was used. That is, in the comparison example, ATVC control is executed for every printing job, so ATVC control is executed 10,000 times throughout the durability test. On the other hand, in Embodiment 3, ATVC control is executed only three times, that is, once at a start of the durability test and twice at every 5,000 sheets.

Table 3 shows results of the durability test. The electric resistance of the secondary transfer roller 24 was measured under the environment of 23° C. in temperature, 50% RH in relative humidity by pressing the secondary transfer roller 24 on the aluminum cylinder with the force of 9.8 N, rotating at the peripheral speed of 50 mm/sec, and applying the voltage of 1000 V. Further, the cleaning performance was evaluated by sampling output images during the durability test and observing whether or not cleaning defects occurred on the output images until the printing of 10,000 sheets ended. An evaluation criterion was that the case where the cleaning defects did not occur is "o (good)" and the case where the cleaning defects occurred is "x (poor)". Incidentally, in both the comparative example and Embodiment 3, any transfer defects due to insufficient transfer voltage (transfer current) or any image defects due to discharge caused by excessive transfer voltage (transfer current) did not occur in images on the recording material P, including images in the leading end portion of the recording material P, throughout the durability test.

TABLE 3

| | CE*1 | EMB*2 |
|---|---|---|
| IE*3 | $3.0 \times 10^7\ \Omega$ | $3.0 \times 10^7\ \Omega$ |
| ER*4 | $6.0 \times 10^7\ \Omega$ | $5.4 \times 10^7\ \Omega$ |
| IV*5 | $3.0 \times 10^7\ \Omega$ | $2.4 \times 10^7\ \Omega$ |
| CD*6 | x | ○ |

*1"CE" is the comparison example.
*2"EMB" is Embodiment.
*3"IE" is the initial electric resistance value of the secondary transfer roller 24.
*4"ER" is the electric resistance value after the durability test of the secondary transfer roller 24.
*5"IV" is the increased value of the electric resistance of the secondary transfer roller 24.
*6"CD" is the cleaning defects.

As shown in Table 3, the increase of the electric resistance of the secondary transfer roller 24 is suppressed and the cleaning performance of the intermediary transfer belt 20 is maintained, more in Embodiment 3 than in the comparison example. This is because that it is considered that the bleed out of the ion conductive agent of the secondary transfer roller 24 and the intermediary transfer belt 20 can be suppressed by applying the voltage of the opposite polarity Incidentally, in Embodiment 3, in the case where ATVC control is not executed, the voltage of the opposite polarity from the time of image forming is applied, however, the present invention is not limited to such a condition. For example, in Embodiment 3, the voltage may be controlled as follows during the period when the voltage of the opposite polarity from the time of image forming is applied. For example, the applied voltage may be simply turned off or an absolute value of the applied voltage may be reduced. Further, the voltage may be applied in a form of a pulse, or the polarity of the applied voltage may be switched alternately (singly or multiple times) between the opposite polarity and the same polarity from the time of image forming (That is, the applied voltage may be an alternating voltage). These may be combined. Turning off the applied voltage or reducing the absolute value of the applied voltage is effective in suppressing the bleed out of ion-conductive transfer members and the conductive deterioration of electro-conductive transfer members. Further, employing the applied voltage in the form of the pulse or in the form of the alternating voltage is effective particularly in suppressing the bleed out of the ion-conductive transfer members. These methods of controlling the voltage may be appropriately adjusted according to the constitution of the image forming apparatus in view of suppressing effects of the bleed out and the conductive deterioration, and the like effects.

Further, other control operations (adjustment operations), which are carried out instead of ATVC control, are not limited to the operation to suppress the bleed out. For example, it may be a cleaning operation of the secondary transfer roller 24, in which the voltage of the opposite polarity from the timing of image forming is applied to the secondary transfer roller 24 to remove the toner attached to the secondary transfer roller 24. In this case, since a time required for additionally carrying out the cleaning operation can be saved, it is effective in suppressing the deterioration of the members and reducing a downtime.

Then, on the basis of the coverage ratio indicating the ratio occupied by the image region per predetermined area for the toner image to be transferred to the transferred member P from the image bearing member 20, the printer control device 304 is capable of determining an operation setting of the control operation (adjustment operation) which may be started before the toner image is transferred to the transferred member P. In this case, the printer control device

304 is capable of determining an absolute value of the control voltage, a polarity of the control voltage, or a waveform of the control voltage as the operation setting of the control operation. For example, the printer control device 304 is capable of determining the absolute value of the control voltage so that the absolute value of the control voltage is smaller for the second value of the coverage ratio, which is smaller than the first value of the coverage ratio described above, than for the first value of the coverage ratio. Further, the printer control device 304 is capable of determining the polarity of the control voltage so that when the coverage ratio is the first value, the polarity of the control voltage is the same as the polarity of the transfer voltage applied to the transfer member 24 at a time of transferring the toner image to the transferred member 20, and when the coverage ratio is the second value, which is smaller than the first value, the polarity of the control voltage is the opposite polarity from the transfer voltage. Further, the printer control device 304 is capable of determining the waveform of the control voltage so that the control voltage is the DC voltage when the coverage ratio is the first value, and the control voltage is the pulsed voltage or the alternating voltage when the coverage ratio is the second value, which is smaller than the first value.

As described above, in Embodiment 3, in the case where the coverage ratio of the image in the leading end portion of the recording material P to which the secondary transfer voltage is applied at the target voltage value calculated by ATVC control is sufficiently small, it is determined that it is not necessary to execute ATVC control and ATVC control is not executed. And, instead, the voltage of the opposite polarity from the time of image forming (secondary transferring) is applied to the secondary transfer roller 24. As a result, the bleed out of the ion conductive agent of the secondary transfer roller 24 and the intermediary transfer belt 20 is suppressed and, consequentially, it is possible that the preferable cleaning performance of the cleaning blade is maintained and the increase of the electric resistance of the secondary transfer roller 24 is reduced.

[Others]

The present invention was explained based on the specific embodiments mentioned above, but is not limited to the embodiments described above.

Further, in the embodiments described above, each of the primary transfer member and the secondary transfer member was a roller shaped member, but may also be a brush like member, a sheet like member, or the like.

Further, in the embodiments described above, the four image forming portions were provided in the image forming apparatus, but the present invention is not limited to such a condition, for example, five or more (for example, six) image forming portions may be provided.

Further, a constitution in which a roller (inner roller) corresponding to the secondary transfer opposite roller in the embodiments described above is used as the secondary transfer member and in which to this roller, the secondary transfer voltage of the same polarity as the normal change polarity of the toner is applied may also be employed. In this case, a roller (outer roller) corresponding to the secondary transfer roller in the embodiments described above is used as an opposite roller, and this roller may only be required to be electrically grounded.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-172242 filed on Oct. 12, 2020, which is hereby incorporated by reference herein in its entirety.

What is claimed is:

1. An image forming apparatus comprising:

an image bearing member configured to bear a toner image;

a transfer member configured to form a transfer portion where the toner image is transferred from said image bearing member onto a transferred member;

a voltage applying portion configured to apply a voltage to said transfer member; and a controller configured to be capable of starting a control operation by applying a control voltage to said transfer member before the toner image is transferred to said transferred member from said image bearing member, wherein on the basis of a coverage ratio indicating a ratio occupied by an image region per predetermined area regarding the toner image transferred to said transferred member from said image bearing member, said controller controls at least one of execution or non-execution of the control operation capable of being started before the toner image is transferred to said transferred member, operation setting of the control operation, and timing of transferring the toner image to said transferred member with respect to a period where the control operation is executed.

2. An image forming apparatus according to claim 1, wherein said transferred member is a recording material to which the toner image is transferred from said image bearing member, and wherein on the basis of the coverage ratio regarding the toner image transferred to a predetermined area of the recording material on a leading end side with respect to a feeding direction of the recording material, said controller controls the control operation capable of being started before the toner image is transferred to the recording material.

3. An image forming apparatus according to claim 1, wherein on the basis of the coverage ratio regarding the toner image transferred to a predetermined area of said transferred member on a leading end side with respect to a feeding direction of an image formation region where the toner image is capable of being transferred onto the transferred member, said controller controls the control operation capable of being started before the toner image is transferred to said transferred member.

4. An image forming apparatus according to claim 1, wherein said controller controls execution of the control operation in a case in which the coverage ratio is a first value, and controls non-execution of the control operation in a case in which the coverage ratio is a second value smaller than the first value.

5. An image forming apparatus according to claim 4, wherein on the basis of the control operation to be executed when the coverage ratio is the first value, said controller controls a transfer voltage applied to said transfer member when the toner image is transferred onto said transferred member.

6. An image forming apparatus according to claim 1, wherein said controller determines at least one of a time for applying the control voltage, an absolute value of the control voltage, a polarity of the control voltage and a waveform of the control voltage as the operation setting of the control operation.

7. An image forming apparatus according to claim 6, wherein said controller controls so that the time for applying the control voltage in a case in which the coverage ratio is a first value is longer than that in a case in which the coverage ratio is a second value smaller than the first value.

8. An image forming apparatus according to claim 6, wherein said controller controls so that the absolute value of the control voltage in a case in which the coverage ratio is a first value is larger than that in a case in which the coverage ratio is a second value smaller than the first value.

9. An image forming apparatus according to claim 6, wherein said controller controls so that the polarity of the control voltage is the same polarity as the polarity of a transfer voltage applied to said transfer member when the toner image is transferred onto said transferred member in a case in which the coverage ratio is a first value, and the polarity of the control voltage is the opposite polarity as the polarity of the transfer voltage in a case in which the coverage ratio is a second value smaller than the first value.

10. An image forming apparatus according to claim 6, wherein said controller controls the waveform of the control voltage so that the control voltage is a DC voltage in a case in which the coverage ratio is a first value, and the control voltage is a pulsed voltage or an AC voltage in a case in which the coverage ratio is a second value smaller than the first value.

11. An image forming apparatus according to claim 1, wherein said controller controls so that a period when the control operation is executed does not overlap a period when the toner image is transferred onto said transferred member in a case in which the coverage ratio is a first value, and the period when the control operation is executed overlaps at least a part of the period when the toner image is transferred onto said transferred member in a case in which the coverage ratio is a second value smaller than the first value.

12. An image forming apparatus comprising:

an image bearing member configured to bear a toner image;

a transfer member configured to form a transfer portion where the toner image is transferred from said image bearing member onto a transferred member;

a voltage applying portion configured to apply a voltage to said transfer member; and a controller configured to be capable of, when a print job for forming an image onto one or a plurality of recording materials by one starting instruction is executed and before a first recording material reaches said transfer portion, executing a control operation by applying a control voltage to said transfer member and setting a target value of a transfer voltage applied to said transfer member when at least a part of the first recording material including a predetermined area of the first recording material on a leading end side with respect to a feeding direction of the first recording material passes through said transfer portion, wherein, when the print job is executed, on the basis of a coverage ratio indicating a ratio occupied by an image region per predetermined area regarding the toner image transferred to the first recording material, said controller determines execution or non-execution of the control operation before the first recording material reaches said transfer portion.

13. An image forming apparatus according to claim 12, wherein said controller controls execution of the control operation in a case in which the coverage ratio is a first value, and controls non-execution of the control operation in a case in which the coverage ratio is a second value smaller than the first value.

14. An image forming apparatus according to claim 12, wherein when said controller determines non-execution of the control operation, on the basis of the control operation in a previous print job, said controller sets the target value of the transfer voltage applied to said transfer member when at least a part of a first recording material, in a current print job, including the predetermined area of the first recording material passes through said transfer portion.

15. An image forming apparatus according to claim 12, wherein said image bearing member is a photosensitive member which bears the toner image to be transferred to a recording material as said transferred member, or an intermediary transfer member which feeds and transfers the toner image transferred from said photosensitive member to the recording material as said transferred member.

16. An image forming apparatus comprising:

an image bearing member configured to bear a toner image;

a transfer member configured to form a transfer portion where the toner image is transferred from said image bearing member onto a transferred member;

a voltage applying portion configured to apply a voltage to said transfer member; and a controller configured to be capable of executing, when a print job for forming an image onto one or a plurality of recording materials by one starting instruction is executed and before a first recording material reaches said transfer portion, a control operation by applying a control voltage to said transfer member and setting a target value of a transfer voltage applied to said transfer member when at least a part of the first recording material including a predetermined area of the first recording material on a leading end side with respect to a feeding direction of the first recording material passes through said transfer portion, wherein, when the print job is executed, on the basis of a coverage ratio indicating a ratio occupied by an image region per predetermined area regarding the toner image transferred to the first recording material, said controller determines a time for applying the control voltage in the control operation before the first recording material reaches said transfer portion.

17. An image forming apparatus according to claim 16, wherein said controller controls so that the time for applying the control voltage in a case in which the coverage ratio is a first value is longer than that in a case in which the coverage ratio is a second value smaller than the first value.

18. An image forming apparatus comprising:

an image bearing member configured to bear a toner image;

a transfer member configured to form a transfer portion where the toner image is transferred from said image bearing member onto a transferred member;

a voltage applying portion configured to apply a voltage to said transfer member; and a controller configured to be capable of starting, when a print job for forming an image onto one or a plurality of recording materials by one starting instruction is executed and before starting transfer of the toner image to be formed on a first recording material from said image bearing member to said transferred member, a control operation by applying a control voltage to said transfer member and setting a target value of a transfer voltage applied to said transfer member within at least a part of a period when the toner image is transferred to said transferred member, wherein, when the print job is executed, on the basis of a coverage ratio indicating a ratio occupied by an image region per predetermined area regarding the toner image transferred to a predetermined area of said transferred member on a leading end side with respect to a feeding direction of an image formation region where the toner image to be formed on the first recording material is capable of being transferred onto the transferred member, said controller controls a timing of starting transfer of the toner image to be formed on the first recording material from said image bearing member to said transferred member.

19. An image forming apparatus according to claim 18, wherein said controller controls so that a period when the control operation is executed does not overlap a period when the toner image is transferred onto said transferred member in a case in which the coverage ratio is a first value, and the period when the control operation is executed overlaps at least a part of the period when the toner image is transferred onto said transferred member in a case in which the coverage ratio is a second value smaller than the first value.

20. An image forming apparatus according to claim 18, wherein said transferred member is an intermediary transfer member which feeds and transfers the toner image transferred from said image bearing member to the recording material, or the recording material to which the toner image is transferred from said image bearing member.

* * * * *